US011440166B2

(12) United States Patent
Iwata et al.

(10) Patent No.: US 11,440,166 B2
(45) Date of Patent: Sep. 13, 2022

(54) IMPACT TOOL AND METHOD OF CONTROLLING IMPACT TOOL

(71) Applicant: KOKI HOLDINGS CO., LTD., Tokyo (JP)

(72) Inventors: Kazutaka Iwata, Ibaraki (JP); Yoshihiro Komuro, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 63 days.

(21) Appl. No.: 16/792,253

(22) Filed: Feb. 16, 2020

(65) Prior Publication Data

US 2020/0180125 A1 Jun. 11, 2020

Related U.S. Application Data

(63) Continuation of application No. 14/653,074, filed as application No. PCT/JP2013/084773 on Dec. 18, 2013, now Pat. No. 10,562,160.

(30) Foreign Application Priority Data

Dec. 22, 2012 (JP) ..... 2012-280363

(51) Int. Cl.
*B25B 21/02* (2006.01)
*B25B 23/147* (2006.01)

(52) U.S. Cl.
CPC ..... *B25B 21/02* (2013.01); *B25B 21/026* (2013.01); *B25B 23/1475* (2013.01)

(58) Field of Classification Search
CPC ... B25B 21/02; B25B 21/026; B25B 23/1475; B25B 21/008

(Continued)

(56) References Cited

U.S. PATENT DOCUMENTS 6,680,595 B2 1/2004 Ito
2002/0053892 A1 5/2002 Schaer et al.

(Continued)

FOREIGN PATENT DOCUMENTS

JP 63-74576 A 4/1988
JP 2004-66413 A 3/2004

(Continued)

OTHER PUBLICATIONS

Japanese Office Action for the related Japanese Patent Application No. 2012-280363 dated Jul. 12, 2016.

(Continued)

*Primary Examiner* — Andrew M Tecco
*Assistant Examiner* — Nicholas E Igbokwe
(74) *Attorney, Agent, or Firm* — Kenealy Vaidya LLP

(57) ABSTRACT

An impact tool and method can include: a motor; a trigger; a controller configured to control driving power supplied to the motor using a semiconductor switching element according to an operation of the trigger; a striking mechanism configured to drive a tip tool continuously or intermittently by rotation force of the motor, the striking mechanism including a hammer and an anvil. The controller drives the semiconductor switching element at a high duty ratio when the trigger is manipulated. The motor can be driven so that the duty ratio is lowered before a first striking of the hammer on the anvil is performed and the first striking is performed at a low duty ratio lower than the high duty ratio.

16 Claims, 13 Drawing Sheets

(58) Field of Classification Search
USPC ..... 173/1, 2, 93
See application file for complete search history.

(56) References Cited

U.S. PATENT DOCUMENTS

| | | | | |
|---|---|---|---|---|
| 2005/0057207 | A1 | 3/2005 | Bosch et al. | |
| 2007/0000676 | A1* | 1/2007 | Arimura | B25B 23/1475 173/179 |
| 2007/0097566 | A1 | 5/2007 | Woods et al. | |
| 2009/0051306 | A1* | 2/2009 | Matsunaga | B25F 5/00 318/434 |
| 2010/0027979 | A1* | 2/2010 | Matsunaga | H02P 6/06 388/811 |
| 2010/0096155 | A1* | 4/2010 | Iwata | B25B 23/1475 173/176 |
| 2010/0307782 | A1 | 12/2010 | Iwata et al. | |
| 2011/0000688 | A1 | 1/2011 | Iwata | |
| 2011/0214894 | A1 | 9/2011 | Harada et al. | |
| 2011/0284255 | A1* | 11/2011 | Ookubo | H02P 27/08 173/109 |
| 2012/0169256 | A1 | 7/2012 | Suda et al. | |
| 2012/0191250 | A1* | 7/2012 | Iwata | B25F 5/00 700/275 |
| 2012/0234566 | A1 | 9/2012 | Mashiko et al. | |
| 2012/0279736 | A1 | 11/2012 | Tanimoto et al. | |
| 2013/0133912 | A1 | 5/2013 | Mizuno et al. | |

FOREIGN PATENT DOCUMENTS

| | | | |
|---|---|---|---|
| JP | 2008-278633 | A | 11/2008 |
| JP | 2009-269138 | A | 11/2009 |
| JP | 2012-40629 | A | 3/2012 |
| JP | 2012-115926 | A | 6/2012 |
| JP | 2012-139784 | A | 7/2012 |
| WO | 2009/136664 | A1 | 11/2009 |

OTHER PUBLICATIONS

International Search Report and Written Opinion of the International Search Report for PCT/JP2013/084773 dated Mar. 14, 2014.

* cited by examiner

IMPACT TOOL AND METHOD OF CONTROLLING IMPACT TOOL

This application is a continuation application claiming priority under 35 U.S.C. 120 to U.S. patent application Ser. No. 14/653,074 filed on Jun. 17, 2015, U.S. Pat. No. 10,562,160 issuing on Feb. 18, 2020, which was a U.S. national phase filing under 35 U.S.C. § 371 of PCT Application No. PCT/JP2013/084773, filed Dec. 18, 2013, and which in turn claims priority under 35 U.S.C. § 119 to Japanese Patent Application No. JP2012-280363, filed Dec. 22, 2012, the entireties of which are incorporated by reference herein.

TECHNICAL FIELD

The present invention relates to an impact tool and, more particularly, to an impact tool in which a control method of a motor used as a driving source is improved.

BACKGROUND ART

A portable impact tool, especially, a cordless impact tool which is driven by the electric energy accumulated in a battery is widely used. In the impact tool where a tip tool such as a drill or a driver is rotationally driven by a motor to perform a required work, the battery is used to drive a brushless DC motor, as disclosed in JP2008-278633A, for example. The brushless DC motor refers to a DC motor which has no brush (brush for rectification). The brushless DC motor employs a coil (winding) at a stator side and a permanent magnet at a rotor side and has a configuration that power driven by an inverter is sequentially energized to a predetermined coil to rotate the rotor. The brushless DC motor has a high efficiency, as compared to a motor with a brush and is capable of obtaining a high output using a rechargeable secondary battery. Further, since the brushless DC motor includes a circuit on which a switching element for rotationally driving the motor is mounted, it is easy to achieve an advanced rotation control of the motor by an electronic control.

The brushless DC motor includes a rotor having a permanent magnet and a stator having multiple-phase armature windings (stator windings) such as three-phase windings. The brushless DC motor is mounted together with a position detecting element configured by a plurality of Hall ICs which detect a position of the rotor by detecting a magnetic force of the permanent magnet of the rotor and an inverter circuit which drives the rotor by switching DC voltage supplied from a battery pack, etc., using semiconductor switching elements such as FET (Field Effect Transistor) or IGBT (Insulated Gate Bipolar Transistor) and changing energization to the stator winding of each phase. A plurality of position detecting elements correspond to the multiple-phase armature windings and energization timing of the armature winding of each phase is set on the basis of position detection results of the rotor by each of the position detecting elements.

FIG. 12 is a graph showing a relationship among a motor current, a duty ratio of PWM drive signal and a fastening torque in a conventional impact tool. Here, an operation for fastening a screw, etc., is performed in such a way that an operator pulls a trigger at time $t_0$ to rotate the motor. At this time, the duty ratio 202 of the PWM drive signal is 100%. (3) of FIG. 12 represents a fastening torque value (N/m). The fastening torque value 203 is gradually increased with the lapse of time. Then, when a reaction force from a fastening member is equal to or greater than a predetermined torque value, the hammer is retracted relative to the anvil and therefore engagement relationship between the anvil and the hammer is released. As the engagement relationship is released, the hammer is rotated while moving forward and collides with the anvil at time $t_1$ whereby a powerful fastening torque is generated against the anvil. At this time, the duty ratio of the PWM supplied to the inverter circuit for driving the motor is in a state of 100%, i.e., in a full power state, as indicated by the duty ratio 202 in (2) of FIG. 12. The motor current in such a motor drive control is represented by the motor current 201 in (1) of FIG. 12. The motor current 201 is rapidly increased as indicated by an arrow 201*a* according to the retreat of the hammer and reaches a peak current (arrow 201*b*) just before the engagement state is released. Then, the motor current 201 is rapidly decreased when the engagement state is released. Then, striking is performed at an arrow 201*c* and the engagement state is obtained again, so that the motor current 201 begins to increase again.

Now, a relationship between movement of a striking part of the impact tool including the hammer and anvil and increase/decrease of the motor current will be described with reference to FIG. 13. A hammer 210 is moved forward and backward by the action of a cam mechanism provided in a spindle. The hammer is rotated in contact with an anvil while a reaction force from the anvil 220 is small. However, as the reaction force is increased, the hammer 210 begins to retreat to a motor side (upper side in FIG. 13) as indicated by an arrow 231 while compressing a spring along a spindle cam groove of the cam mechanism ((A) of FIG. 13). Then, when a convex portion of the hammer 210 rides over the anvil 220 by the retreat movement of the hammer 210 and therefore engagement between the hammer and the anvil is released, the hammer 210 is rapidly accelerated and moved forward (as indicated by an arrow 233) by the action of the cam mechanism and an elastic energy accumulated in the spring while being rotated (as indicated by an arrow 232) by a rotation force of the spindle ((B) of FIG. 13). Then, the convex portion of the hammer 210 collides with the anvil 220 and the hammer and the anvil are engaged with each other again, so that the hammer and the anvil begin to rotate integrally, as indicated by an arrow 234 ((C) of FIG. 13). At this time, a powerful rotational striking force is exerted to the anvil 22. A motor current 240 (unit: A) at this time is represented in a lower curve. The motor current 240 reaches a peak as indicated by an arrow 240*a* when the hammer is moved backward as indicated by the arrow 231 while compressing the spring along the spindle cam groove of the cam mechanism. Then, the engagement state between the hammer 210 and the anvil 220 is released, as shown in (B) of FIG. 13. At this time, the reaction force is not applied to the hammer 210 and therefore load becomes lighter. As a result, the motor current 240 is decreased, as indicated by an arrow 240*b*. Then, striking is performed in the vicinity where the motor current 240 is nearly decreased, as indicated by an arrow 240*c*. Here, the arrows 201*b* and 201*c* in FIG. 12 correspond to the portion of the arrows 240*a* to 240*c* in FIG. 13.

Explanation is made by referring to FIG. 12, again. In a case that a screw fastening member is a short screw, the striking may be performed at time $t_1$ in FIG. 12 (i.e., at the time indicated by the arrow 201*c*) if a torque value suddenly exceed a setting torque value $T_N$ by the first striking, as indicated by an arrow 203*a* in (3) of FIG. 12. However, in the case of an electric tool that is not automatically stopped even when the torque value reaches the setting torque value, striking may be further performed several times before an operator releases a trigger. For example, in the example of (3) of FIG. 12, second striking is performed at time $t_2$ and the motor current at this time is increased or decreased, as indicated by the arrows 201*c* to 201*f*. At this time, there is a possibility that screw threads are broken or a screw head is twisted and cut, in some cases.

SUMMARY OF THE INVENTION

By the way, recently, increase of the output of the impact tool has been achieved and therefore it is possible to obtain a high rotational speed and a high fastening torque while reducing the size of the tool. However, realizing the high fastening torque causes striking stronger than necessary to be applied when performing the first striking in a screw fastening work or the like. As a result, damage risk of screw becomes even higher. As a countermeasure, it is considered that the fastening work is performed in a state where the rotation speed of the motor is decreased in order to reduce the impact. However, in this case, the time required for the entire fastening becomes longer and therefore decrease in operation efficiency is caused.

The present invention has been made in view of the above background and an object thereof is to provide an impact tool which is capable of fastening a small screw or pan head screw, etc., at high speed with high accuracy.

Another object of the present invention is to provide an impact tool which is capable of preventing breakage of screw head during striking without decreasing the fastening efficiency.

Yet another object of the present invention is to provide an impact tool which is capable of fastening a self-drilling screw having a prepared hole function or a tapping screw with high efficiency.

Aspects of the present invention to be disclosed in the present application are as follows.

(1) An impact tool comprising:

a motor;

a trigger;

a controller configured to control driving power supplied to the motor using a semiconductor switching element according to an operation of the trigger; and a striking mechanism configured to drive a tip tool continuously or intermittently by rotation force of the motor, the striking mechanism including a hammer and an anvil, wherein the controller drives the semiconductor switching element at a high duty ratio when the trigger is manipulated, and wherein the motor is driven so that the duty ratio is lowered before a first striking of the hammer on the anvil is performed and the first striking is performed at a low duty ratio lower than the high duty ratio.

(2) The impact tool according to (1), wherein switching from the high duty ratio to the low duty ratio is performed before engagement between the hammer and the anvil is released.

(3) The impact tool according to (1), wherein switching from the high duty ratio to the low duty ratio is performed before the hammer begins to retreat.

(4) The impact tool according to (1) to (3) further comprising a current detector configured to detect a current value of current flowing through the motor or the semiconductor switching element, wherein the controller is controlled so that the duty ratio is switched from the high duty ratio to the low duty ratio when the current value exceeds a first threshold for a first time.

(5) The impact tool according to (1) to (4), wherein the motor is a brushless DC motor, and the brushless DC motor is driven by an inverter circuit using a plurality of semiconductor switching elements.

(6) The impact tool according to (4) or (5), wherein the high duty ratio is set in the range of 80 to 100%, and the low duty ratio is set to a value that is equal to or less than 60% of the high duty ratio set.

(7) The impact tool according to (4) or (5), wherein the controller stops the driving of the motor when the current value exceeds a second threshold.

(8) The impact tool according to (4) to (7), wherein the controller is configured to perform:

an increasing process of continuously increasing the low duty ratio at a predetermined rate when the current value detected by the current detector is equal to or less than the first threshold after switching from the high duty ratio to the low duty ratio as long as the duty ratio after increase does not exceed the high duty ratio, a returning process of returning the duty ratio to the low duty ratio again when the current value detected by the current detector exceeds the first threshold again, and a repeating process of repeating the increasing process and the returning process.

(9) The impact tool according to (4) to (7), wherein the low duty ratio is returned to the high duty ratio when the current value detected by the current detector is equal to or less than a third threshold that is sufficiently lower than the first threshold after switching to the low duty ratio, and the motor is driven so that the duty ratio is switched to the low duty ratio from the high duty ratio before next striking of the hammer on the anvil is performed and the next striking is performed at the low duty ratio.

(10) A method of controlling an impact tool including a motor, a trigger, a semiconductor switch element which controls driving power supplied to the motor and a striking mechanism configured to drive a tip tool continuously or intermittently by rotation force of the motor, the striking mechanism including a hammer and an anvil, the method comprising:

driving the semiconductor switch element at a high duty ratio when the trigger is manipulated;

lowering the high duty ratio to a lower duty ratio before a first striking of the hammer on the anvil is performed; and performing the first striking at the low duty ratio.

According to the invention described in (1), the controller is driven at a high duty ratio when the trigger is pulled but the striking is performed in a state where the duty ratio is switched to a low duty ratio just before the first striking. Accordingly, it is possible to effectively prevent the breakage of the screw head or screw groove or the damage of the member to be fastened without reducing the operating speed, even when a short screw or a self-drilling screw having a prepared hole function is used in an impact driver using a high-power motor. As a result, it is possible to employ a high-power motor and also it is possible to reduce power consumption of the motor. Further, it is possible to improve the reliability and life of the impact tool.

According to the invention described in (2), since switching of the duty ratio is performed before engagement between the hammer and the anvil is released, fastening is carried out at maximum speed until striking is performed and the duty ratio is reliably reduced during the striking, so that impact striking can be performed by a suitable striking force. Conventionally, the current is decreased immediately after the engagement is released. Thereafter, the hammer is already started to accelerate by the force of a spring even when the duty ratio is reduced and therefore the striking force of the first striking is substantially reduced. However, according to the invention described in (2), since switching of the duty ratio is performed before engagement between the hammer and the anvil is released, the first striking can be performed at a low duty ratio.

According to the invention described in (3), since switching of the duty ratio is performed before the hammer begins to retreat, it is possible to prevent reduction of the fastening speed due to reduction of the duty ratio. In this case, since the time until the engagement releasing is too short when the hammer begins to retreat and then the duty ratio is reduced, there is a possibility that the speed of the motor is not sufficiently reduced. However, according to the invention described in (3), it is possible to sufficiently reduce the speed of the motor by rapidly reducing the duty ratio.

According to the invention described in (4), since the controller is controlled so that the duty ratio is switched from a high duty ratio to a low duty ratio when the current value detected by the current detector exceeds a first threshold for the first time, it is possible to switch the duty ratio just before performing the striking without separately providing a special detection sensor.

According to the invention described in (5), since the brushless DC motor for driving an inverter circuit is used, it is possible to perform a delicate fastening control by the control of the duty ratio.

According to the invention described in (6), since the high duty ratio is set in the range of 80 to 100% and the low duty ratio is set to a value that is equal to or less than 60% of the high duty ratio set, it is possible to securely complete a fastening work at the specified torque without causing lack of fastening torque.

According to the invention described in (7), since the controller stops the driving of the motor when the current value exceeds the second threshold, it is possible to prevent insufficient fastening or excessive fastening.

According to the invention described in (8), since the duty ratio is gradually increased at a predetermined rate after the duty ratio is dropped to the low duty ratio, it is possible to perform a variation control of the duty ratio by a simple processing without tracking the peak value of the motor current after the duty ratio is dropped to the low duty ratio for the first time. Further, even the controller using a microcomputer with a low processing capacity can realize the processing of the present invention.

According to the invention described in (9), since the low duty ratio is returned to the high duty ratio again when the current value is equal to or less than a third threshold that is sufficiently lower than the first threshold after switching to the low duty ratio, it is possible to normally complete the fastening work even when the current value is temporarily increased due to some factors such as disturbance. Accordingly, it is possible to prevent the occurrence of insufficient fastening.

The foregoing and other objects and features of the present invention will be apparent from the detailed description below and accompanying drawings.

DETAILED DESCRIPTION OF EXEMPLARY EMBODIMENTS

First Embodiment

Hereinafter, an illustrative embodiment of the present invention will be described with reference to the accompanying drawings. In the following description, a front-rear direction and an upper-lower direction are referred to the directions indicated by arrows of FIG. 1.

Figure 1:
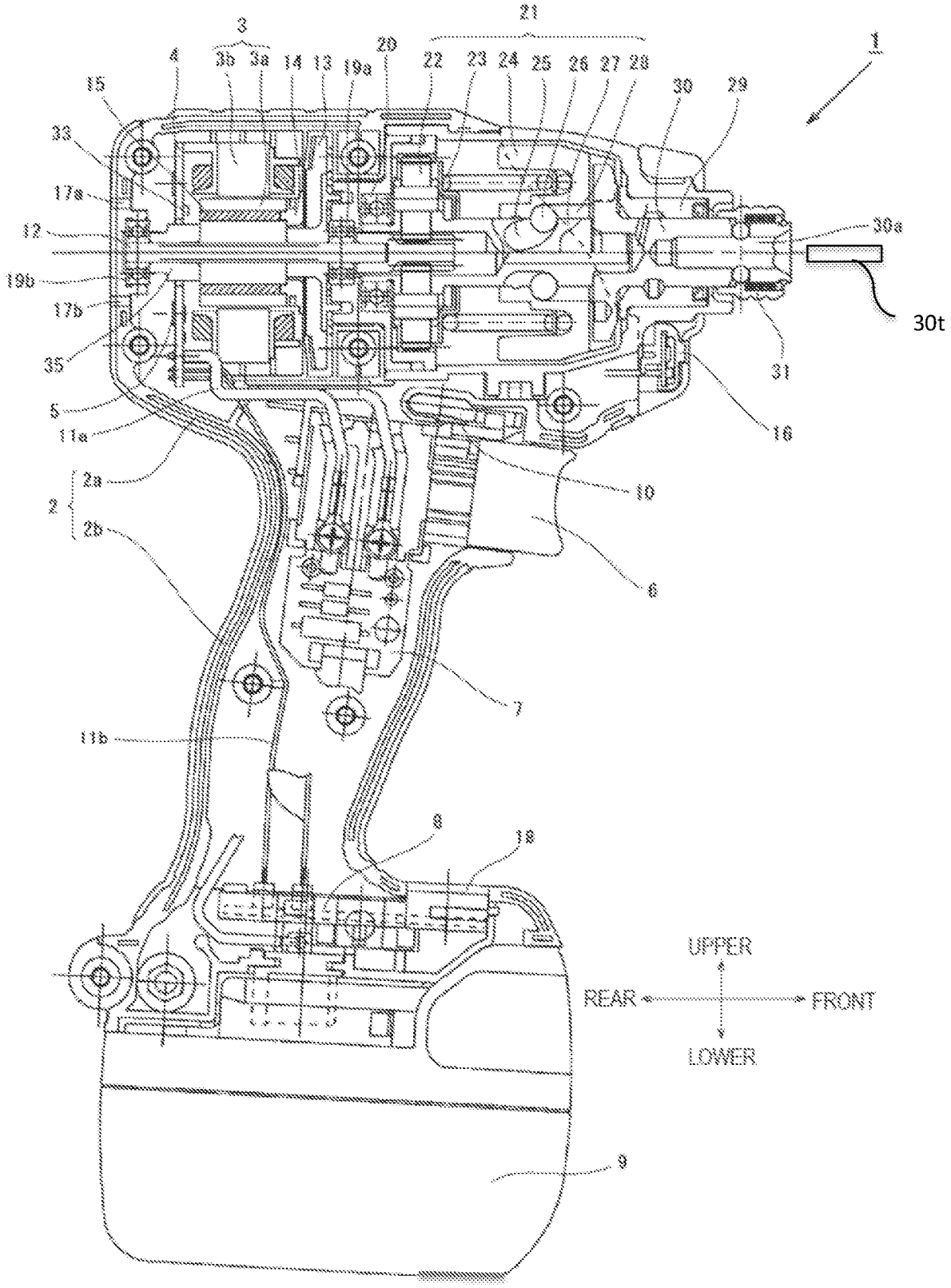
FIG. 1 is a longitudinal sectional view showing an internal structure of an impact tool according to an illustrative embodiment of the present invention.

FIG. 1 is a view showing an internal structure of an impact tool 1 according to the present invention. The impact tool 1 is powered by a rechargeable battery 9 and uses a motor 3 as a driving source to drive a rotary striking mechanism 21. The impact tool 1 applies a rotating force and a striking force to an anvil 30 which is an output shaft. The impact tool 1 intermittently transmits a rotational striking force to a tip tool 31*t* such as a driver bit to fasten a screw or a bolt. Here, the tip tool is held on an mounting hole 30*a* of a sleeve 31. The brushless DC type motor 3 is accommodated in a cylindrical main body 2*a* of a housing 2 which is substantially T-shaped, as seen from the side. A rotating shaft 12 of the motor 3 is rotatably held by a bearing 19*a* and a bearing 19*b*. The bearing 19*a* is provided near the center of the main body 2*a* of the housing 2 and the bearing 19*b* is provided on a rear end side thereof. A rotor fan 13 is provided in front of the motor 3. The rotor fan 3 is mounted coaxial with the rotating shaft 12 and rotates in synchronous with the motor 3. An inverter circuit board 4 for driving the motor 3 is arranged in the rear of the motor 3. Air flow generated by the rotor fan 13 is introduced into the housing 2 through air inlets 17*a*, 17*b* and a slot (not shown) formed on a portion of the housing around the inverter circuit board 4. And then, the air flow mainly flows to pass through between a rotor 3*a* and a stator 3*b*. In addition, the air flow is sucked form the rear of the rotor fan 13 and flows in the radial direction of the rotor fan 13. The air flow is discharged to the outside of the housing 2 through a slot formed on a portion of the housing around the rotor fan 13. The inverter circuit board 4 is a double-sided board having a circular shape substantially equal to an outer shape of the motor 3. A plurality of switching elements 5 such as FETs or a position detection element 33 such as hall IC is mounted on the inverter circuit board.

Between the rotor 3*a* and the bearing 19*a*, a sleeve 14 and the rotor fan 13 are mounted coaxially with the rotating shaft 12. The rotor 3*a* forms a magnetic path formed by a magnet 15. For example, the rotor 3*a* is configured by laminating four plate-shaped thin metal sheets which are formed with slot. The sleeve 14 is a connection member to allow the rotor fan 13 and the rotor 3*a* to rotate without idling and made from plastic, for example. As necessary, a balance correcting groove (not shown) is formed at an outer periphery of the sleeve 14. The rotor fan 13 is integrally formed by plastic molding, for example. The rotor fan is a so-called centrifugal fan which sucks air from an inner peripheral side at the rear and discharges the air radially outwardly at the front side. The rotor fan includes a plurality of blades extending radially from the periphery of a through-hole which the rotating shaft 12 passes through. A plastic spacer 35 is provided between the rotor 3*a* and the bearing 19*b*. The spacer 35 has an approximately cylindrical shape and sets a gap between the bearing 19*b* and the rotor 3*a*. This gap is intended to arrange the inverter circuit board 4 (see FIG. 1) coaxially and required to form a space which is necessary as a flow path of air flow to cool the switching elements 5.

A handle part 2*b* extends substantially at a right angle from and integrally with the main body 2*a* of the housing 2. A switch trigger (SW trigger) 6 is disposed on an upper side region of the handle part 2*b*. A switch board 7 is provided below the switch trigger 6. A forward/reverse switching lever 10 for switching the rotation direction of the motor 3 is provided above the switch trigger 6. A control circuit board 8 is accommodated in a lower side region of the handle part 2*b*. The control circuit board 8 has a function to control the speed of the motor 3 by an operation of pulling the switch trigger 6. The control circuit board 8 is electrically connected to the battery 9 and the switch trigger 6. The control circuit board 8 is connected to the inverter circuit board 4 via a signal line 11*b*. Below the handle part 2*b*, the battery 9 including a nickel-cadmium battery, a lithium-ion battery or the like is removably mounted. The battery 9 is packed with a plurality of secondary batteries such as lithium ion battery, for example. When charging the battery 9, the battery 9 is removed from the impact tool 1 and mounted on a dedicated charger (not shown).

The rotary striking mechanism 21 includes a planetary gear reduction mechanism 22, a spindle 27 and a hammer 24. A rear end of the rotary striking mechanism is held by a bearing 20 and a front end thereof is held by a metal 29. As the switch trigger 6 is pulled and thus the motor 3 is started, the motor 3 starts to rotate in a direction set by the forward/reverse switching lever 10. The rotating force of the motor 3 is decelerated by the planetary gear reduction mechanism 22 and transmitted to the spindle 27. Accordingly, the spindle 27 is rotationally driven in a predetermined speed. Here, the spindle 27 and the hammer 24 are connected to each other by a cam mechanism. The cam mechanism includes a V-shaped spindle cam groove 25 formed on an outer peripheral surface of the spindle 27, a hammer cam groove 28 formed on an inner peripheral surface of the hammer 24 and balls 26 engaged with these cam grooves 25, 28.

A spring 23 normally urges the hammer 24 forward. When stationary, the hammer 24 is located at a position spaced away from an end surface of the anvil 30 by engagement of the balls 26 and the cam grooves 25, 28. Convex portions (not shown) are symmetrically formed, respectively in two locations on the rotation planes of the hammer 24 and the anvil 30 which are opposed to each other. As the spindle 27 is rotationally driven, the rotation of the spindle is transmitted to the hammer 24 via the cam mechanism. At this time, the convex portion of the hammer 24 is engaged with the convex portion of the anvil 30 before the hammer 24 makes a half turn, thereby the anvil 30 is rotated. However, in a case where the relative rotation is generated between the spindle 27 and the hammer 24 by an engagement reaction force at that time, the hammer 24 begins to retreat toward the motor 3 while compressing the spring 23 along the spindle cam groove 25 of the cam mechanism.

As the convex portion of the hammer 24 gets beyond the convex portion of the anvil 30 by the retreating movement of the hammer 24 and thus engagement between these convex portions is released, the hammer 24 is rapidly accelerated in a rotation direction and also in a forward direction by the action of the cam mechanism and the elastic energy accumulated in the spring 23, in addition to the rotation force of the spindle 27. Further, the hammer 24 is moved in the forward direction by an urging force of the spring 23 and the convex portion of the hammer 24 is again engaged with the convex portion of the anvil 30. Thereby, the hammer starts to rotate integrally with the anvil. At this time, since a powerful rotational striking force is applied to the anvil 30, the rotational striking force is transmitted to a screw via a tip tool (not shown) mounted on the mounting hole 30*a* of the anvil 30. Thereafter, the same operation is repeatedly performed and thus the rotational striking force is intermittently and repeatedly transmitted from the tip tool to the screw. Thereby, the screw can be screwed into a member to be fastened (not shown) such as wood, for example.

Figure 2:
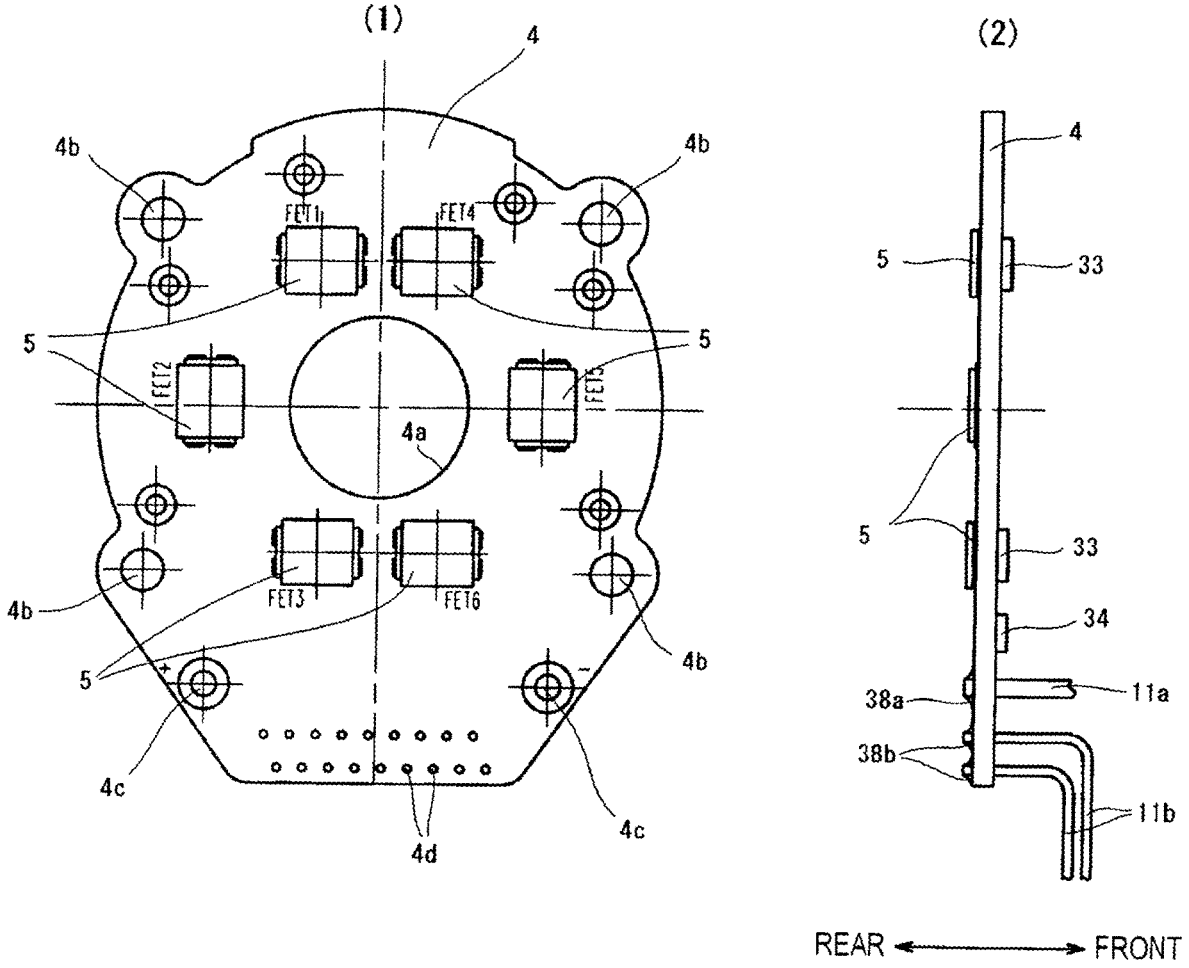
FIG. 2 is a view showing an inverter circuit board 4, (1) of FIG. 2 is a rear view seen from the rear side of the impact tool 1 and (2) of FIG. 2 is a side view as seen from the side of the impact tool.

Next, the inverter circuit board 4 according to the present embodiment will be described with reference to FIG. 2. FIG. 2 is a view showing the inverter circuit board 4, (1) of FIG. 2 is a rear view seen from the rear side of the impact tool 1 and (2) of FIG. 2 is a side view as seen from the side of the impact tool. The inverter circuit board 4 is configured by a glass epoxy (which is obtained by curing a glass fiber by epoxy resin), for example and has an approximately circular shape substantially equal to an outer shape of the motor 3. The inverter circuit board 4 is formed at its center with a hole 4*a* through which the spacer 35 passes. Four screw holes 4*b* are formed around the inverter circuit board 4 and the inverter circuit board 4 is fixed to the stator 3*b* by screws passing through the screw holes 4*b*. Six switching elements 5 are mounted to the inverter circuit board 4 to surround the holes 4*a*. Although a thin FET is used as the switching element 5 in the present embodiment, a normal-sized FET may be used.

Since the switching element 5 has a very thin thickness, the switching element 5 is mounted on the inverter circuit board 4 by SMT (Surface Mount Technology) in a state where the switching element is laid down on the board. Meanwhile, although not shown, it is desirable to coat a resin such as silicon to surround the entire six switching elements 5 of the inverter circuit board 4. The inverter circuit board 4 is a double-sided board. Electronic elements such as three position detection elements 33 (only two shown in (2) of FIG. 2) and the thermistor 34, etc., are mounted on a front surface of the inverter circuit board 4. The inverter circuit board 4 is shaped to protrude slightly below a circle the same shape as the motor 3. A plurality of through-holes 4*d* are formed at the protruded portion. Signal lines 11*b* pass through the through-holes 4*d* from the front side and then are fixed to the rear side by soldering 38*b*. Similarly, a power line 11*a* passes through a through-hole 4*c* of the inverter circuit board 4 from the front side and then is fixed to the rear side by soldering 38*a*. Alternatively, the signal lines 11*b* and the power line 11*a* may be fixed to the inverter circuit board 4 via a connector which is fixed to the board.

Figure 3:
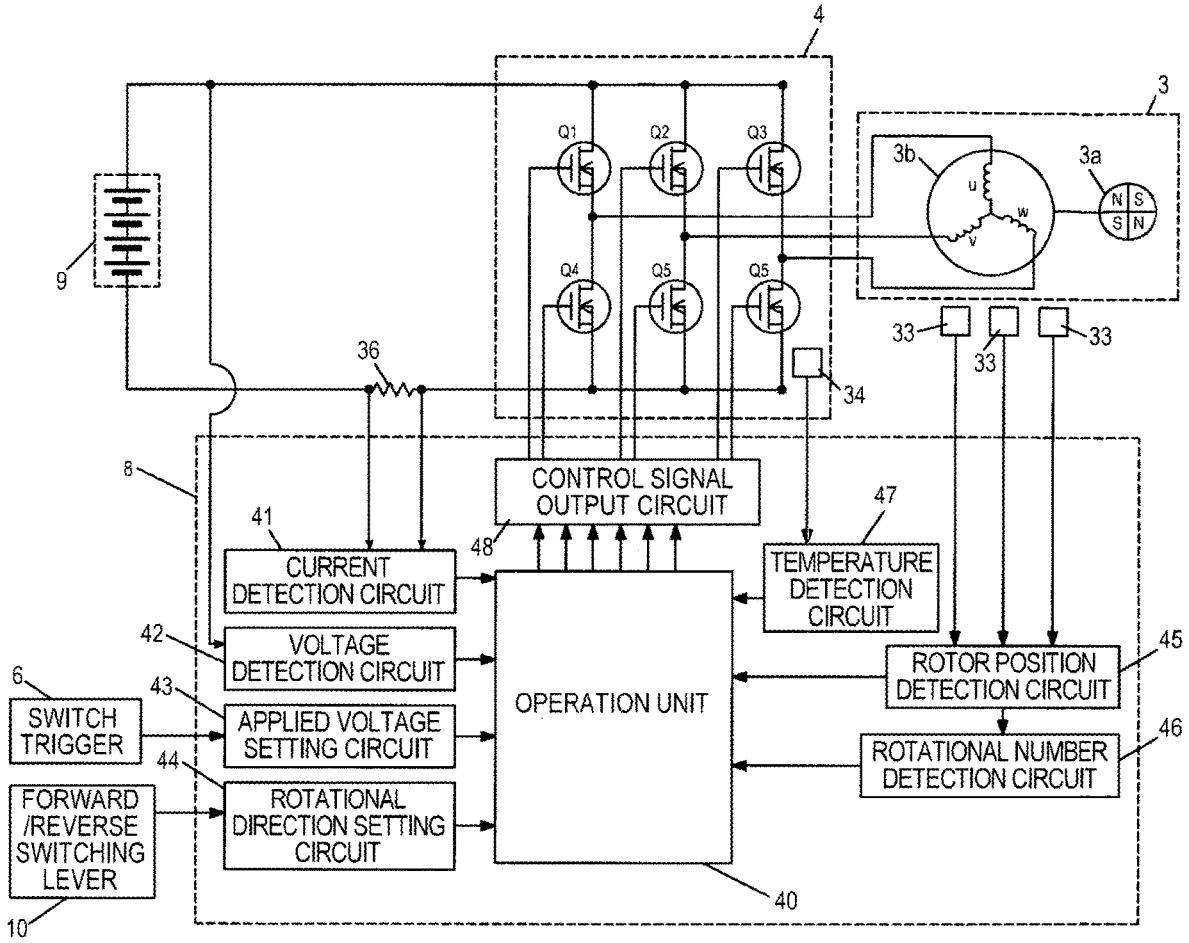
FIG. 3 is a block diagram showing a circuit configuration of a drive control system of a motor 3 according to the illustrative embodiment of the present invention.

Next, a configuration and operation of a drive control system of the motor 3 will be described with reference to FIG. 3. FIG. 3 is a block diagram illustrating a configuration of the drive control system of the motor. In the present embodiment, the motor 3 is composed of three-phase brushless DC motor.

The motor 3 is a so-called inner rotor type and includes the rotor 3*a*, three position detection elements 33 and the stator 3*b*. The rotor 3*a* is configured by embedding the magnet 15 (permanent magnet) having a pair of N-pole and S-pole. The position detection elements 33 are arranged at an angle of 60° to detect the rotation position of the rotor 3*a*. The stator 3*b* includes star-connected three-phase windings U, V W which are controlled at current energization interval of 120° electrical angle on the basis of position detection signals from the position detection elements 33. In the present embodiment, although the position detection of the rotor 3*a* is performed in an electromagnetic coupling manner using the position detection elements 33 such as Hall IC, a sensorless type may be employed in which the position of the rotor 3*a* is detected by extracting an induced electromotive force (back electromotive force) of the armature winding as logic signals via a filter.

An inverter circuit is configured by six FETs (hereinafter, simply referred to as "transistor") Q1 to Q6 which are connected in three-phase bridge form and a flywheel diode (not shown). The inverter circuit is mounted on the inverter circuit board 4. A temperature detection element (thermistor) 34 is fixed to a position near the transistor on the inverter circuit board 4. Each gate of the six transistors Q1 to Q6 connected in the bridge type is connected to a control signal output circuit 48. Further, a source or drain of the six transistors Q1 to Q6 is connected to the star-connected armature windings U, V W. Thereby, the six transistors Q1 to Q6 perform a switching operation by a switching element driving signal which is outputted from the control signal output circuit 48. The six transistors Q1 to Q6 supply power to the armature windings U, V, W by using DC voltage of the battery 9 applied to the inverter circuit as the three-phase (U phase, V phase, W phase) AC voltages Vu, Vv, Vw.

An operation unit 40, a current detection circuit 41, a voltage detection circuit 42, an applied voltage setting circuit 43, a rotation direction setting circuit 44, a rotor position detection circuit 45, a rotation number detection circuit 46, a temperature detection circuit 47 and the control signal output circuit 48 are mounted on the control circuit board 8. Although not shown, the operation unit 40 is configured by a microcomputer which includes a CPU for outputting a drive signal based on a processing program and data, a ROM for storing a program or data corresponding to a flowchart (which will be described later), a RAM for temporarily storing data and a timer, etc. The current detection circuit 41 is a current detector for detecting current flowing through the motor 3 by measuring voltage across a shunt resistor 36 and the detected current is inputted to the operation unit 40. The voltage detection circuit 42 is a circuit for detecting battery voltage of the battery 9 and the detected voltage is inputted to the operation unit 40.

The applied voltage setting circuit 43 is a circuit for setting an applied voltage of the motor 3, that is, a duty ratio of PWM signal, in response to a movement stroke of the switch trigger 6. The rotation direction setting circuit 44 is a circuit for setting the rotation direction of the motor 3 by detecting an operation of forward rotation or reverse rotation by the forward/reverse switching lever 10 of the motor. The rotor position detection circuit 45 is a circuit for detecting positional relationship between the rotor 3*a* and the armature windings U, V W of the stator 3*b* based on output signals of the three position detection elements 33. The rotation number detection circuit 46 is a circuit for detecting the rotation number of the motor based on the number of the detection signals from the rotor position detection circuit 45 which is counted in unit time. The control signal output circuit 48 supplies PWM signal to the transistors Q1 to Q6 based on the output from the operation unit 40. The power supplied to each of the armature windings U, V W is adjusted by controlling a pulse width of the PWM signal and thus the rotation number of the motor 3 in the set rotation direction can be controlled.

Figure 4:
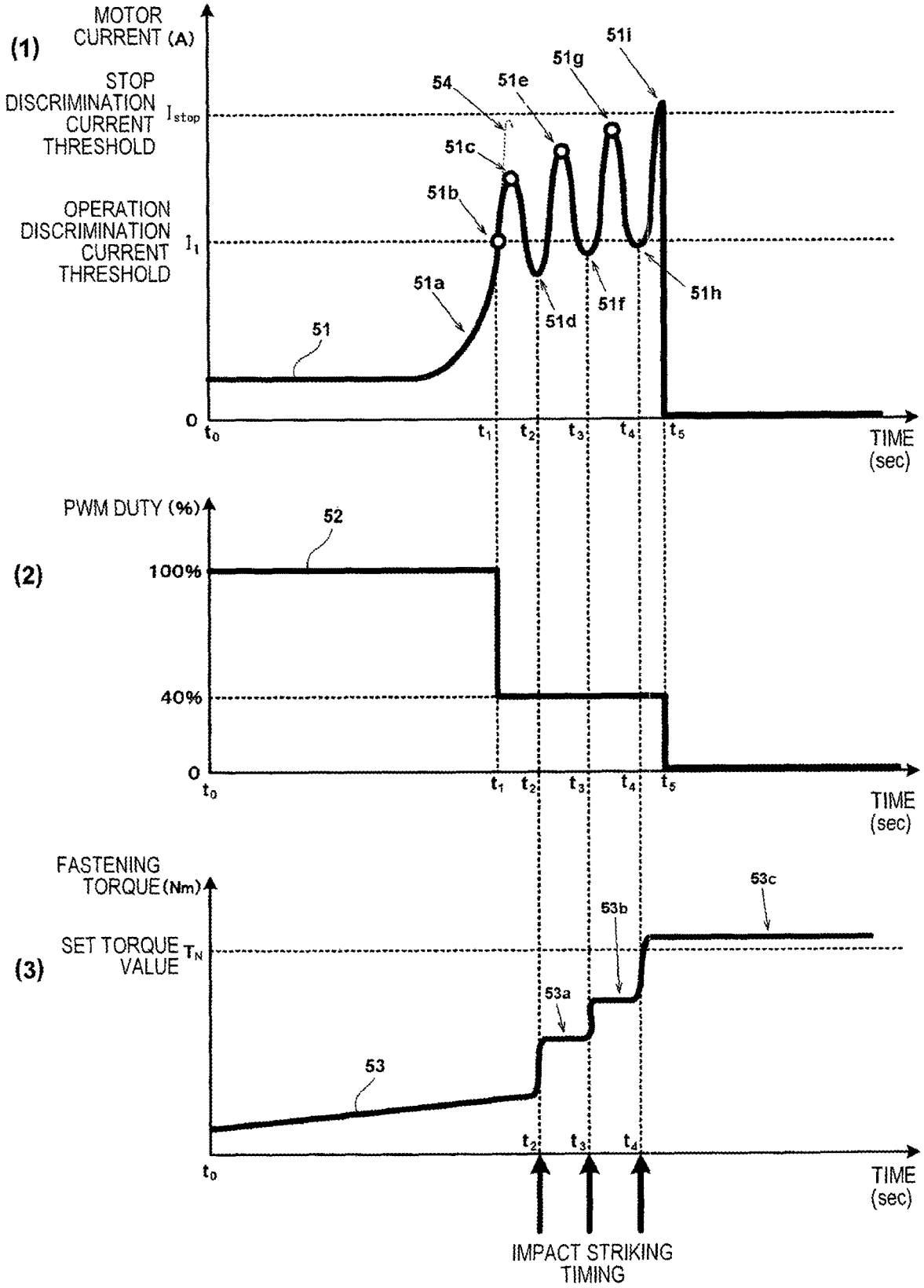
FIG. 4 is a graph showing a relationship among a (1) motor current, a (2) duty ratio of PWM drive signal and a (3) fastening torque in the impact tool according to the illustrative embodiment of the present invention (in the case of fastening a short screw).
Figure 13:
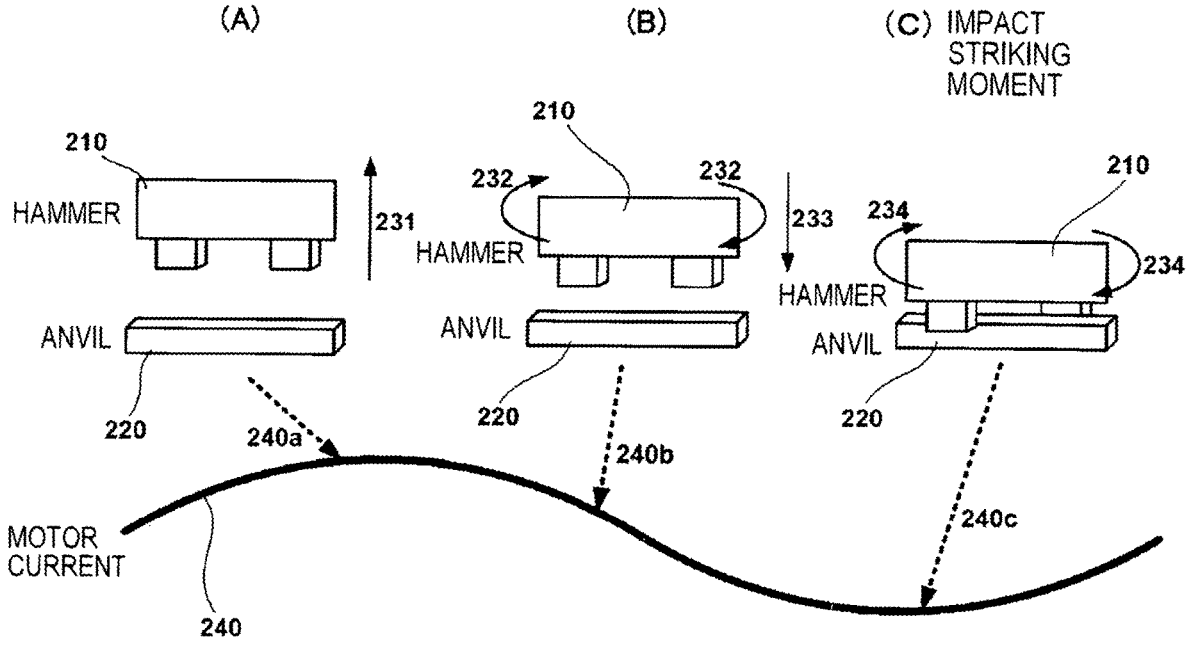
FIGS. 13 *a-c* are schematic views showing a relationship between movement of a striking part of the impact tool including a hammer and anvil and increase/decrease of the motor current.

Next, relationship among the motor current, the duty ratio of PWM drive signal and the fastening torque in the impact tool of the present embodiment will be described by referring to the graph shown in FIG. 4. In Each graph of (1) to (3) of FIG. 4, a horizontal axis represents time (in milliseconds) and each horizontal axis is commonly represented. The present embodiment illustrates an example where a short screw or a short self-drilling screw is fastened using the impact tool 1. In this example, the motor 3 is started by the operation of an operator to pull the trigger 6 at time $t_0$. In this way, a predetermined fastening torque 53 is generated in the anvil 30. As the screw is seated, the reaction force of the torque received from the fastening member is increased. A convex portion of the hammer 24 rides over a convex portion of the anvil 30 by the retreat movement of the hammer 24 and therefore engagement between the hammer and the anvil is released. As a result, the hammer 24 strikes the convex portion of the anvil 30 at time $t_2$ by the action of a cam mechanism and an elastic energy accumulated in a spring 23. (1) of FIG. 4 shows a variation of a motor current 51 up to such a first striking and the variation of the motor current 51 from an arrow 51*b* to an arrow 51*d* corresponds to the variation of the motor current 240 in FIG. 13. Here, the motor current 51 is maximized (arrow 51*c*) before striking of the hammer 24 and when the hammer 24 is retracted rearward. At this time, the load applied to the motor 3 is maximized and therefore the current value reaches a peak.

In the present embodiment, the limit value of the duty ratio 52 in PWM (Pulse Width Modulation) control is decreased to 40% from 100% as in the time $t_1$ of (2) of FIG. 4 when the motor current 51 exceeds a current threshold $I_1$ that is a predetermined threshold (first threshold). The current threshold $I_1$ is an operation discrimination threshold for setting the timing of switching a highly-set duty ratio to a low duty ratio. As the duty ratio 52 is decreased to 40% from 100% in this way, the motor current 51 is shifted to the arrow 51*c* from the arrow 51*b*. In addition, the motor current is rapidly increased as indicated by a dotted line 54 when the duty ratio 52 is not dropped but remains 100% at time $t_1$. Accordingly, there is a possibility that the motor current exceeds a current threshold (second threshold) $I_{STOP}$ for stopping the motor 3 immediately after the first striking (time $t_2$). In this case, striking is abruptly performed against the screw to be fastened. As a result, there is a possibility that the screw head is damaged. Since the duty ratio 52 is decreased to 40% from 100% at time $t_1$ just before performing the first striking in the present embodiment, a rapid fastening by the full power of the motor is performed before striking. Further, subsequent striking is performed in a state where the duty ratio is dropped before striking is carried out by a predetermined turn (¼ turn to one turn, e.g., about ½ turn in the present embodiment).

Since the duty ratio is decreased to 40% at time $t_1$ in this way, it is possible to perform a subsequent striking at a suitable strength. Plural times of striking are performed while the motor current 51 at this time is varied from an arrow 51*d* to an arrow 51*h* depending on the rotational position and longitudinal position of the hammer 24 (FIG. 1). The fastening torque 53 at this time is gradually increased as in arrows 53*a*, 53*b* as a first striking (at time $t_2$) and a second striking (at time $t_3$) are performed. Further, the fastening torque exceeds a fastening torque setting value $T_n$ as in an arrow 53*c* after a third striking (at time $t_4$) is performed. In this way, the fastening is completed. In the present embodiment, the operation unit 40 (FIG. 3) performs the fastening completion by monitoring the motor current 51. Therefore, first, a discrimination current threshold $I_{STOP}$ for stopping rotation of the motor 3 is set. Then, the operation unit 40 stops the control signal to be supplied to an inverter circuit and stops the rotation of the motor 3 when it is detected that the motor current 51 exceeds the current threshold $I_{STOP}$ at time $t_5$ as in an arrow 51*i*. According to the control of the present embodiment, even in the case of the short screw, a suitable striking is performed over plural times as in times $t_2$, $t_3$, $t_4$, instead of performing a strong impact striking one time and completing the fastening work. Accordingly, it is possible to securely complete the fastening work without damaging the screw head.

Figure 5:
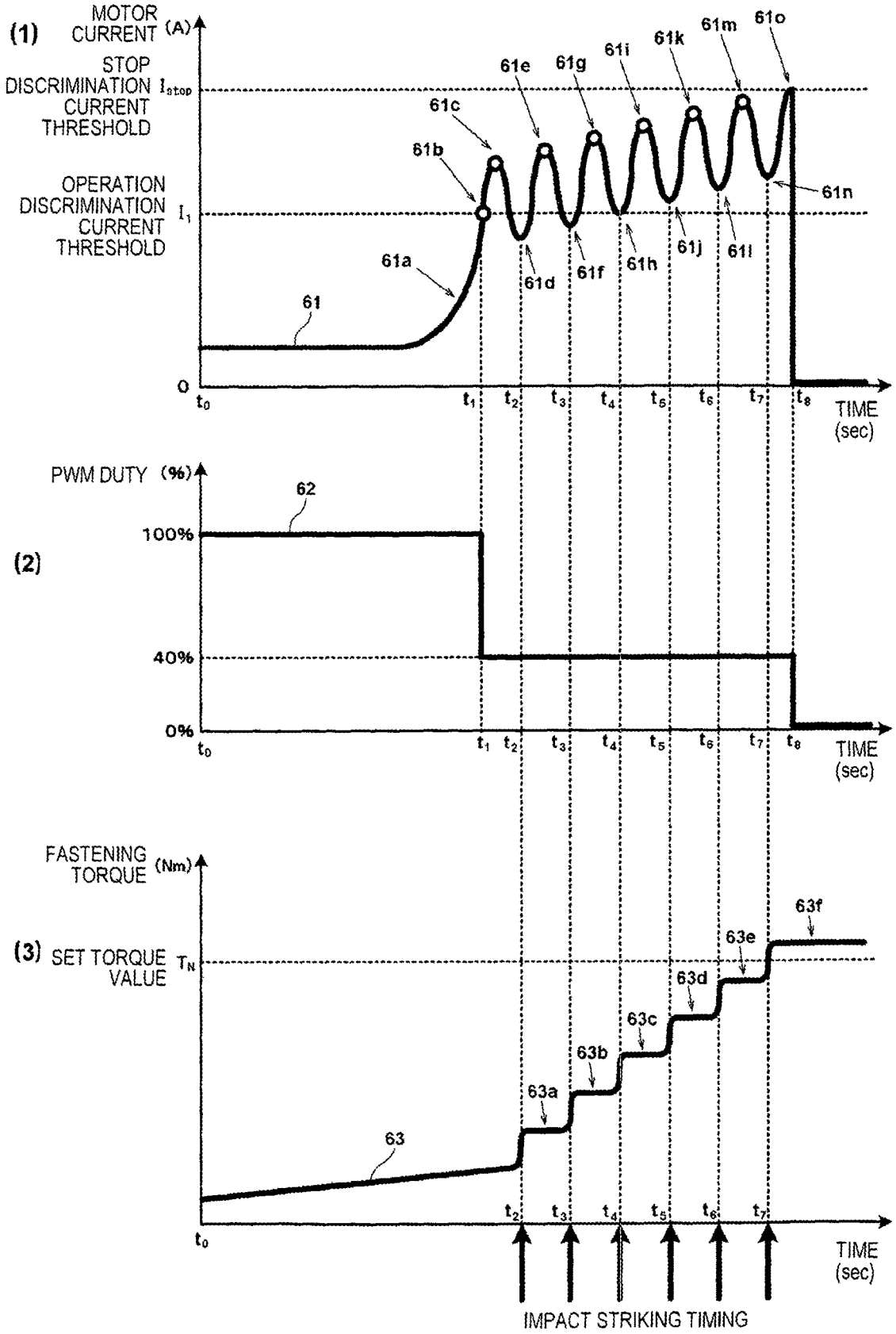
FIG. 5 is a graph showing a relationship among a (1) motor current, a (2) duty ratio of PWM drive signal and a (3) fastening torque in the impact tool according to the illustrative embodiment of the present invention (in the case of fastening a long screw).

Next, relationship among the motor current, the duty ratio of PWM drive signal and the fastening torque in the impact tool of fastening a long screw or a long self-drilling screw will be described by referring to FIG. 5. The control method of the operation unit 40 is the same as that of the operation unit in FIG. 4 and the only difference is that the length of the screw is long and therefore the number of striking required for completing the fastening is increased. First, a motor current 61 is increased in accordance with the fastening situation of the screw when the rotation of the motor 3 is started at time $t_0$. Then, load received from the screw is increased when the fastening of the screw reaches a predetermined step (for example, when the screw is seated or passes through a prepared hole function portion of the self-drilling screw or the self-tapping screw). For this reason, the motor current 61 is rapidly increased as in an arrow 61*a* and exceeds the current threshold $I_1$ at time $t_1$. Accordingly, the operation unit 40 decreases the duty ratio of the PWM from 100% to 40%. Thereafter, the motor current 61 is maximized as in an arrow 61*c* by the retreat of the hammer 24 and then the engagement state between the hammer 24 and the anvil is released, so that the motor current 61 is decreased and a first striking is performed in the vicinity where the motor current is lowermost (arrow 61*d*). At this time, the fastening torque value is increased as in the arrow 63*a*. The same striking is performed at times $t_3$, $t_4$, $t_5$, $t_6$ and the motor current at that time is increased or decreased as in arrows 61*e* to 61*l*. Although the peak current at this time is shown by arrows 61*e*, 61*g*, 61*i*, 61*k*, 61*m*, these peak currents do not exceed the stop discrimination current threshold $I_{STOP}$. At that time, the fastening torque value is increased stepwise, as shown by arrows 63*b*, 63*c*, 63*d*, 63*e*. Then, the motor current 61 exceeds the stop discrimination current threshold $I_{STOP}$ at time $t_8$ as shown by an arrow 610 when a sixth striking is performed at time $t_7$. Therefore, the operation unit 40 stops the rotation of the motor 3. In this way, the fastening torque value 63 exceeds a setting torque value $T_n$ as in an arrow 63*f* by the sixth striking, so that the fastening work is completed.

As described above, in the present embodiment, the duty ratio is switched to a low duty ratio of 40% before the first striking and then subsequent striking is performed, instead of continuously performing the striking at the duty ratio of 100%. In this way, striking is always performed at a low duty ratio. Accordingly, there is no case that the fastening torque abruptly exceeds a setting torque value $T_N$ by the first striking. As a result, it is possible to securely complete the fastening by plural times of striking. In addition, although the high duty ratio and the low duty ratio are set as a combination of 100% and 40% in the present embodiment, each duty ratio may be set as other combinations in such a way that the high duty ratio is set in the range of 80 to 100% and the low duty ratio is set to a value that is equal to or less than 60% of the high duty ratio set. For example, the high duty ratio and the low duty ratio may be set as a combination of 90% and 30%.

Figure 6:
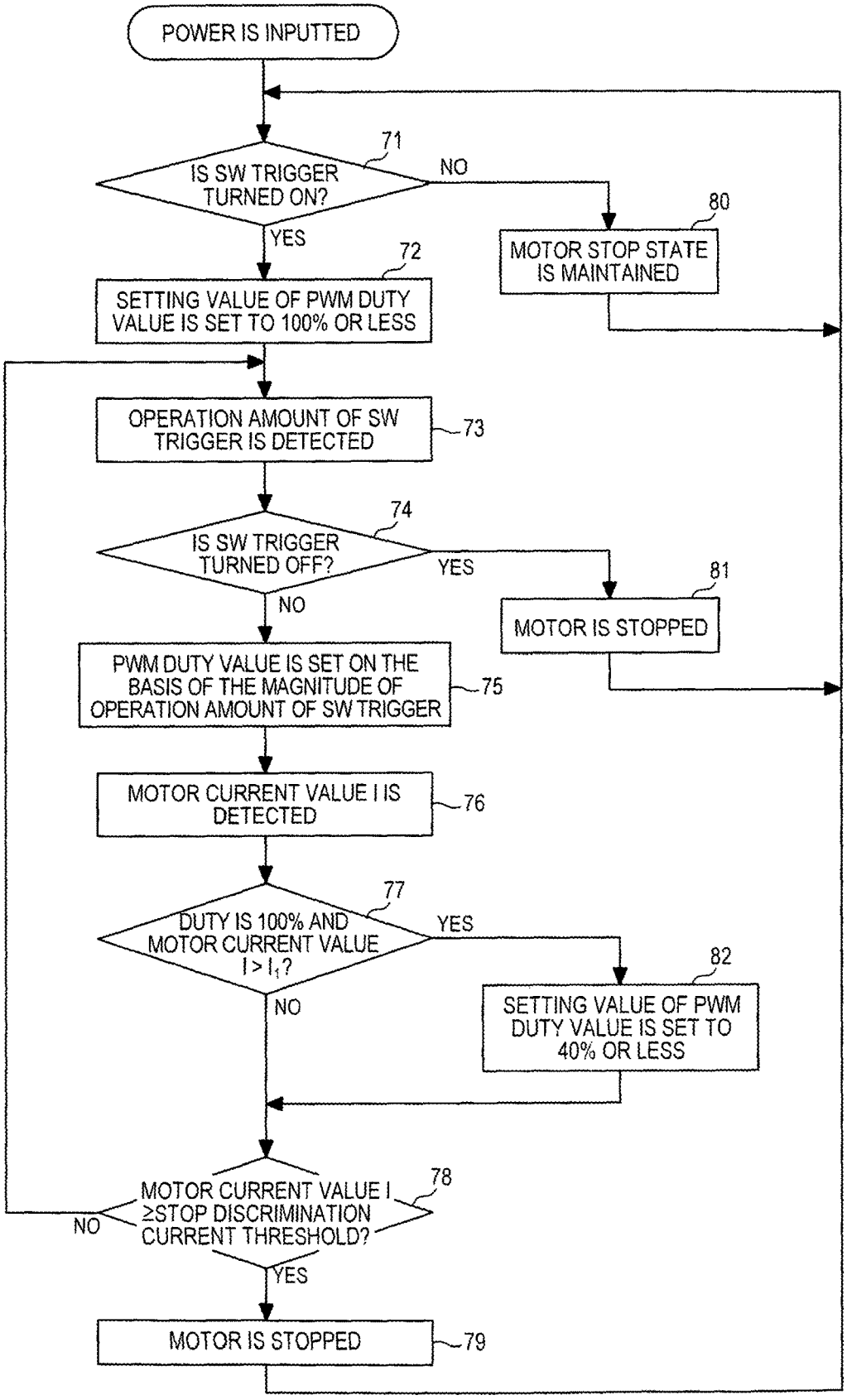
FIG. 6 is a flowchart showing a setting procedure of a duty ratio when performing a fastening work using the impact tool 1 according to the illustrative embodiment of the present invention.

Next, a setting procedure of a duty ratio for the motor control when performing a fastening work by the impact tool 1 will be described by referring to the flowchart of FIG. 6. The control procedure shown in FIG. 6 can be realized in a software manner by causing the operation unit 40 having a microprocessor to execute a computer program, for example. First, the operation unit 40 detects whether or not the switch trigger 6 is pulled and turned on by an operator (Step 71). When it is detected that the switch trigger is pulled, the control procedure proceeds to Step 72. When it is detected in Step 71 that the switch trigger 6 is pulled, the operation unit 40 sets an upper limit value of the PWM duty value to 100% (Step 72) and detects the amount of operation of the switch trigger 6 (Step 73). Next, the operation unit 40 detects whether or not the switch trigger 6 is released and turned off by an operator (Step 74). When it is detected that the switch trigger is still pulled, the control procedure proceeds to Step 75. When it is detected that the switch trigger is released, the operation unit 40 stops the motor 3 (Step 81) and the control procedure returns to Step 71. Next, the operation unit 40 sets the PWM duty value according to the amount of operation of the switch trigger 6 that is detected (Step 75). Here, the PWM duty value according to the amount of operation can be set to (Maximum PWM duty value)×(amount of operation (%)), for example. Next, the operation unit 40 detects the motor current value I using the output of the current detection circuit 41 (Step 76). Next, the operation unit 40 determines whether or not the setting value (upper limit value) of the PWM duty ratio is set to 100% and the detected motor current value I is equal to or greater than the operation discrimination current threshold $I_1$ (Step 77). Here, when it is determined that the motor current value I is equal to or greater than the operation discrimination current threshold $I_1$, the maximum value of the PWM duty ratio is set to 40% (Step 82) and the control procedure proceeds to Step 78. When it is determined that the motor current value I is less than the operation discrimination current threshold $I_1$, the maximum value of the PWM duty ratio is not changed and the control procedure proceeds to Step 78.

Next, the operation unit 40 determines whether or not the detected motor current value I is equal to or greater than the stop discrimination current threshold $I_{STOP}$ (Step 78). When it is determined that the motor current value I is equal to or greater than the stop discrimination current threshold $I_{STOP}$, the operation unit 40 stops the motor in Step 79 and the control procedure returns to Step 71. When it is determined that the motor current value I is less than the stop discrimination current threshold $I_{STOP}$ (Step 78), the control procedure returns to Step 73. By repeating the above-described processing, striking is carried out in such a way that rotation by a high duty ratio is performed until just before a first striking is performed and the duty ratio is switched to the low duty ratio just before less than one rotation from the start of the striking. Accordingly, it is possible to prevent breakage of the screw and also it is possible to securely perform the fastening at a fastening setting torque by plural times of striking. Further, since the motor 3 is driven so as not to generate torque higher than necessary at the time of striking, it is possible to significantly improve the durability of the electric tool even when using a high-power motor 3. Furthermore, since it is possible to reduce the power consumption of the motor 3 when performing the striking, it is possible to extend the life of the battery.

Second Embodiment

Figure 7:
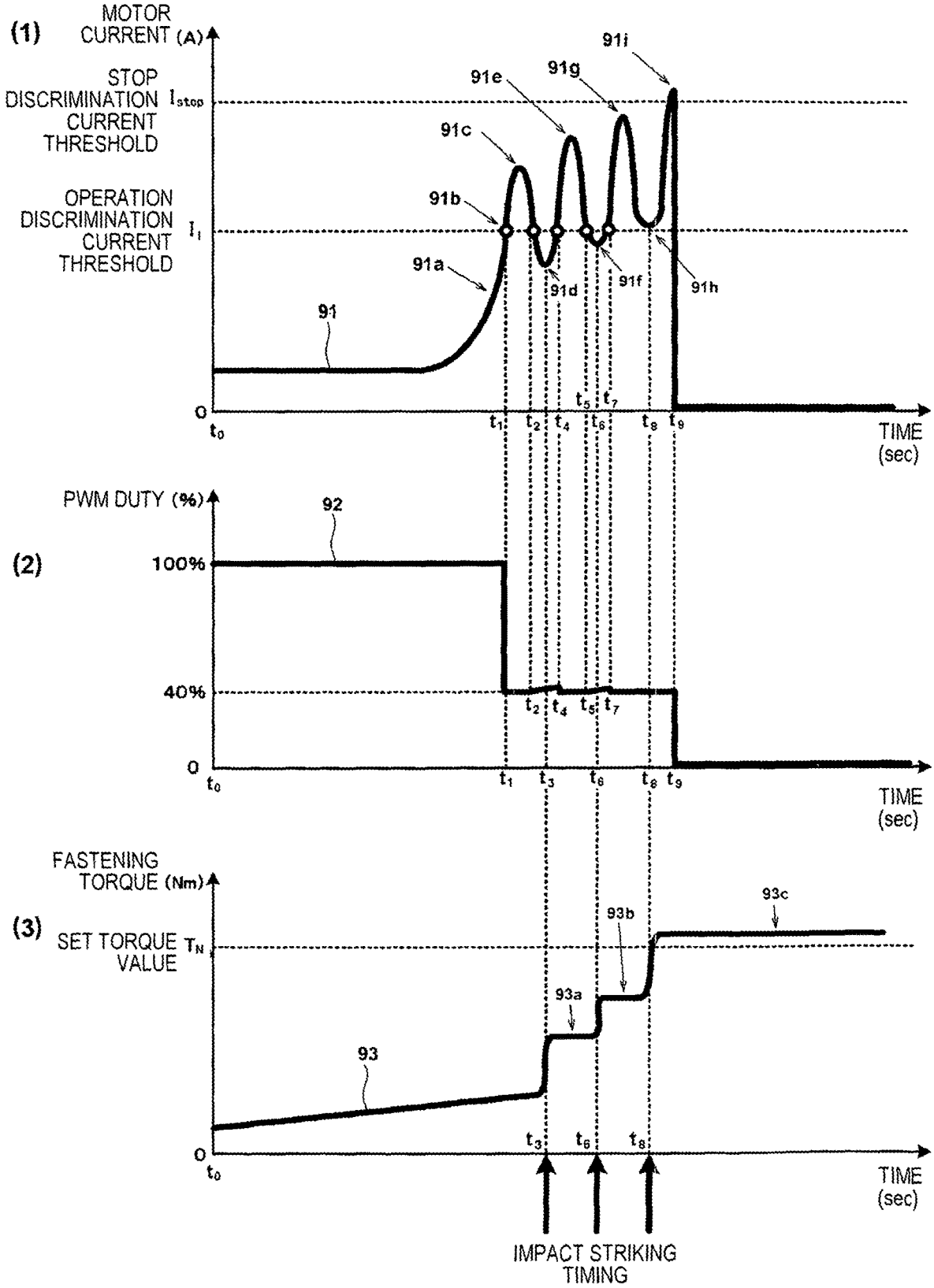
FIG. 7 is a graph showing a relationship among a (1) motor current, a (2) duty ratio of PWM drive signal and a (3) fastening torque in an impact tool according to a second embodiment of the present invention (in the case of fastening a short screw).
Figure 8:
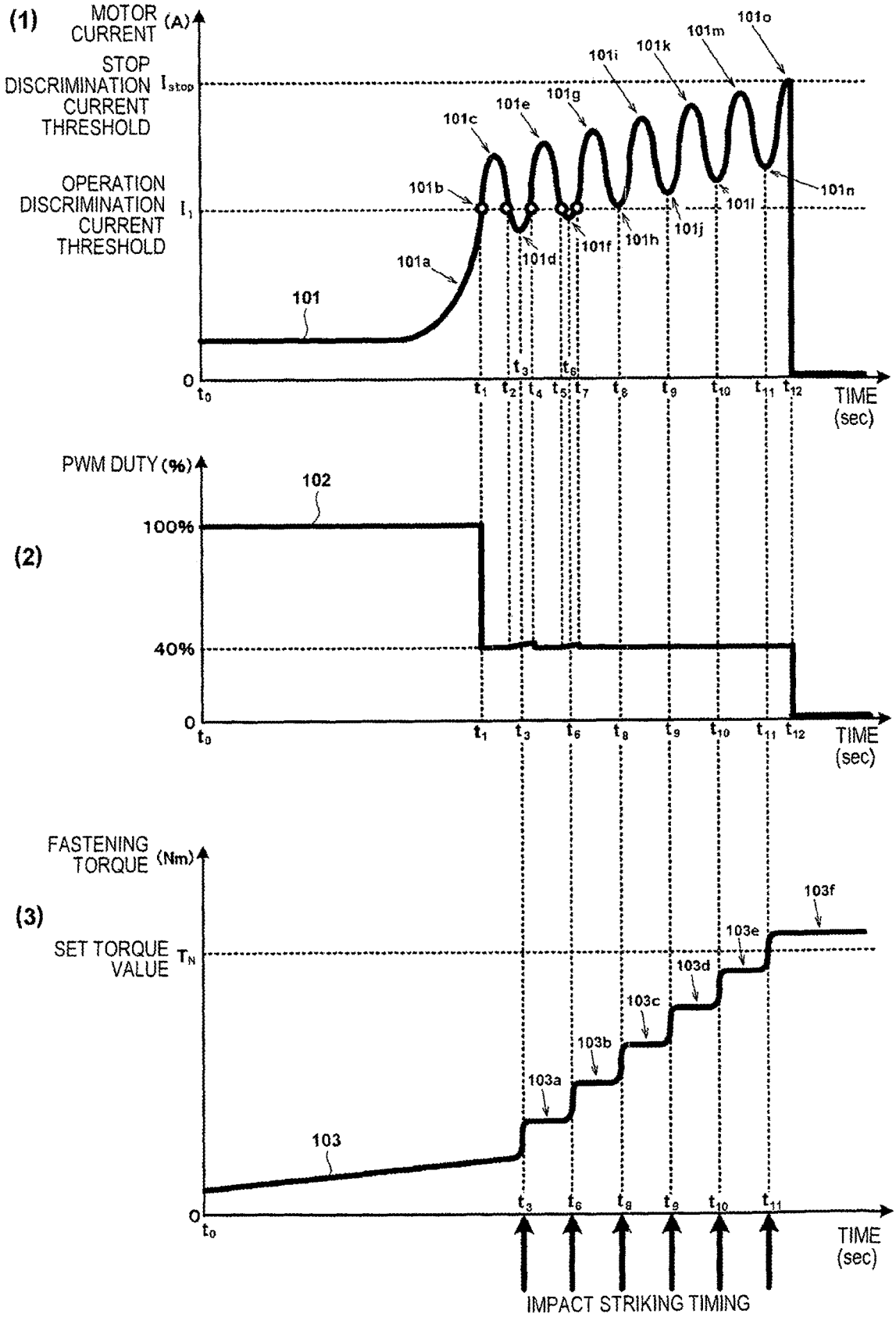
FIG. 8 is a graph showing a relationship among a (1) motor current, a (2) duty ratio of PWM drive signal and a (3) fastening torque in the impact tool according to the second embodiment of the present invention (in the case of fastening a long screw).
Figure 9:
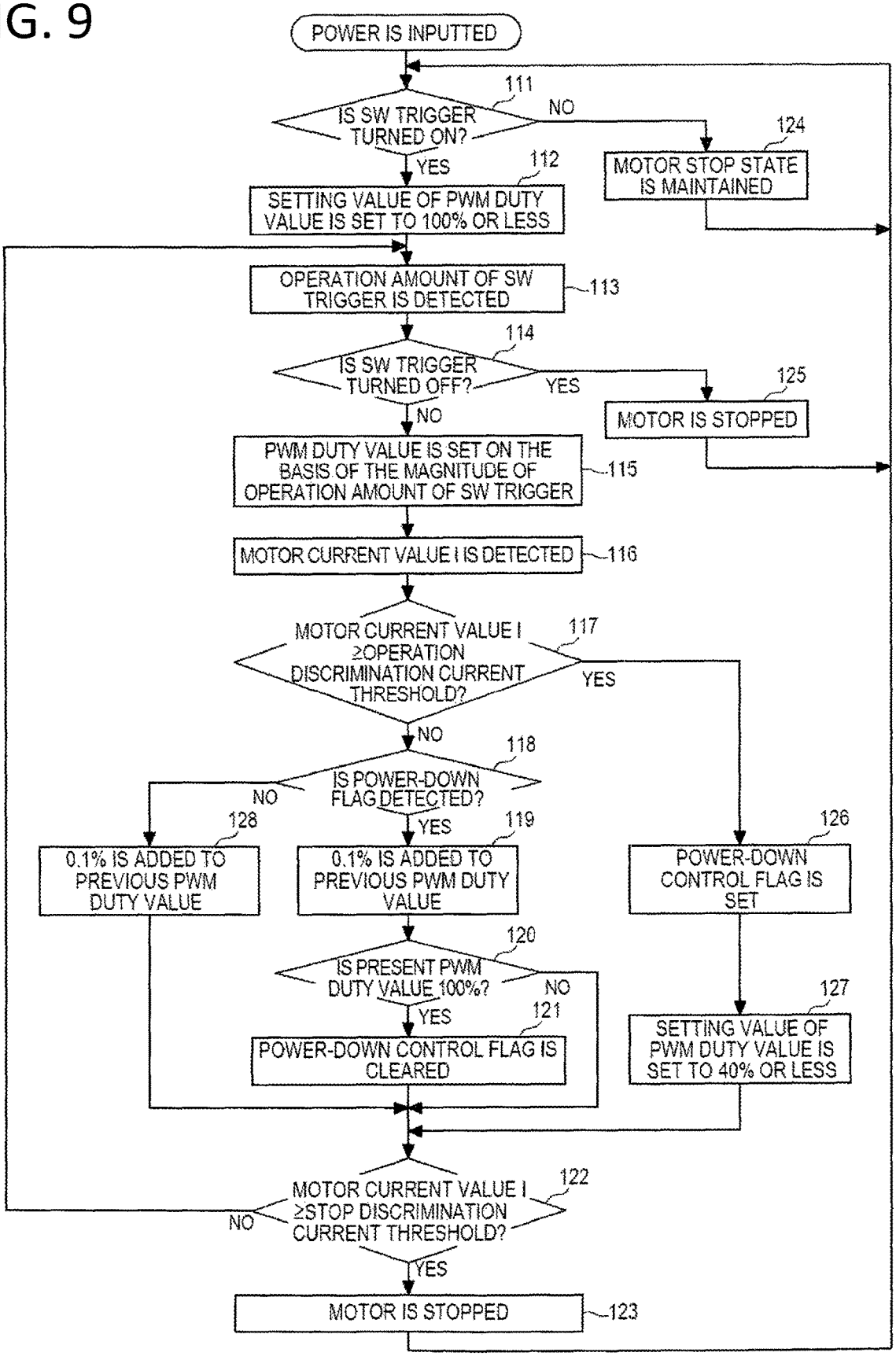
FIG. 9 is a flowchart showing a setting procedure of a duty ratio when performing a fastening work using the impact tool according to the second embodiment of the present invention.

Next, a second embodiment of the present invention will be described with reference to FIG. 7 to FIG. 9. Similarly to the first embodiment, the second embodiment has a configuration that the high duty ratio is lowered just before the first striking is performed. However, in the second embodiment, control is made in such a way that the duty value is gradually increased at a predetermined rate after the duty ratio is lowered to a low duty ratio and while the motor current is maintained in a state of being equal to or less than the current threshold $I_1$.

Now, relationship among the motor current, the duty ratio of PWM drive signal and the fastening torque in the impact tool of the second embodiment will be described by referring to FIG. 7. In each graph of (1) to (3) of FIG. 7, a horizontal axis represents time (in milliseconds) and each horizontal axis is commonly represented. The present embodiment illustrates an example where a short screw is fastened using the impact tool 1. In this example, the motor 3 is started by the operation of an operator to pull the trigger 6 at time $t_0$. In this way, a predetermined fastening torque 93 is generated in the anvil 30. At this time, the operation of the hammer 24 and the anvil 30 is the same as in FIG. 4 and the hammer 24 strikes the anvil 30 at time $t_3$. (1) of FIG. 7 shows a variation of a motor current 91 up to such a first striking. Here, the motor current 91 is a peak (arrow 91*c*) when the hammer 24 is retracted for the first time and the load applied to the motor 3 is maximized. In the present embodiment, the duty ratio 92 of the PWM control is decreased to 40% from 100% as in time $t_1$ of (2) of FIG. 7 when the motor current 91 exceeds a predetermined current threshold $I_1$. As the duty ratio 92 is decreased to 40%, the motor current 91 is changed from an arrow 91*b* up to an arrow 91*c* and a first striking is performed in the vicinity of time $t_3$. Thereafter, in principle, the duty ratio is maintained at about 40%. However, in the present embodiment, the duty ratio is slightly increased with the lapse of time. For example, the duty ratio is slightly increased at a constant rate from time $t_2$ to time $t_4$ in (2) of FIG. 7. However, since the motor current 91 exceeds the first current threshold $I_1$ again at time $t_4$, the increased duty ratio is returned to 40% by being reset. Next, since the motor current 91 is less than the first current threshold $I_1$ again at time $t_5$, the duty ratio is slightly increased with the lapse of time (time $t_5$ to $t_7$). The fastening torque 93 is gradually increased as in arrows 93*a*, 93*c* as the second striking (at time $t_6$) and the third striking (at time $t_8$) are performed by repeating the subsequent processing. In addition, the motor current 91 exceeds the current threshold $I_{STOP}$ at time $t_9$. In this way, the fastening is completed. According to the control of the present embodiment, the processing after the motor current exceeds the first current threshold $I_1$ for the first time can be realized by a relatively simple arithmetic processing in which the duty ratio is slightly increased when the motor current is less than the first current threshold $I_1$ and the duty ratio is set to the low duty ratio (40%) when the motor current exceeds the first current threshold $I_1$. Accordingly, it is not necessary to secure a storage area for holding the peak current and therefore even a microcomputer with a low processing capacity can realize the processing according to the present embodiment.

Now, relationship among the motor current, the duty ratio of PWM drive signal and the fastening torque in the impact tool of the second embodiment will be described by referring to FIG. 8. In Each graph of (1) to (3) of FIG. 7, a horizontal axis represents time (in milliseconds) and each horizontal axis is commonly represented. The present embodiment illustrates an example where a long screw or a self-drilling screw or the like is fastened using the impact tool 1. In this example, the motor 3 is started by the operation of an operator to pull the trigger 6 at time $t_0$. In this way, a predetermined fastening torque 103 is generated in the anvil 30. At this time, the operation of the hammer 24 and the anvil 30 is the same as in FIG. 4 and the hammer 24 strikes the anvil 30 at time $t_3$. (1) of FIG. 8 shows a variation of a motor current 101 up to such a first striking. Here, the motor current 101 is a peak (arrow 101*c*) when the hammer 24 is retracted for the first time and the load applied to the motor 3 is maximized. In the present embodiment, the duty ratio 102 of the PWM control is decreased to 40% from 100% as in time $t_1$ of (2) of FIG. 8 when the motor current 101 exceeds a predetermined current threshold L. As the duty ratio 102 is decreased to 40%, the motor current 101 is changed from an arrow 101*b* up to an arrow 101*c* and a first striking is performed in the vicinity of time $t_3$. Thereafter, in principle, the duty ratio is maintained at about 40%. However, in the present embodiment, the duty ratio is slightly increased with the lapse of time. For example, the duty ratio is slightly increased at a constant rate from time $t_2$ to time $t_4$ in (2) of FIG. 8. However, since the motor current 101 exceeds the first current threshold $I_1$ again at time $t_4$, the increased duty ratio is returned to 40% by being reset. Next, since the motor current 101 is less than the first current threshold $I_1$ again at time $t_5$, the duty ratio is slightly increased with the lapse of time (time $t_5$ to $t_7$). Next, since the motor current 101 exceeds the first current threshold $I_1$ again before striking at time $t_8$, the increased duty ratio is returned to 40% by being reset. However, the motor current 101 remains in a state of exceeding the first current threshold $I_1$ just before the next striking. Accordingly, at this time, the duty ratio is not increased and the duty ratio after time $t_7$ remains in a state of being fixed to 40%. The fastening torque 103 is gradually increased as in arrows 103*a* to 103*f* up to a sixth striking (at time $t_{ii}$) by repeating the subsequent processing. In addition, the motor current 101 exceeds the current threshold $I_{STOP}$ at time $t_{12}$. In this way, the fastening is completed.

Next, a setting procedure of a duty ratio for the motor control when performing a fastening work in the second embodiment will be described by referring to the flowchart of FIG. 9. The control procedure shown in FIG. 9 can be similarly realized in a software manner by causing the operation unit 40 having a microprocessor to execute a computer program, for example. First, the operation unit 40 detects whether or not the switch trigger 6 is pulled and turned on by an operator (Step 111). When it is detected that the switch trigger is pulled, the control procedure proceeds to Step 112. When it is detected in Step 111 that the switch trigger 6 is pulled, the operation unit 40 sets an upper limit value of the PWM duty value to 100% (Step 112) and detects the amount of operation of the switch trigger 6 (Step 113). Next, the operation unit 40 detects whether or not the switch trigger 6 is released and turned off by an operator (Step 114). When it is detected that the switch trigger is still pulled, the control procedure proceeds to Step 115. When it is detected that the switch trigger is released, the operation unit 40 stops the motor 3 (Step 125) and the control procedure returns to Step 111.

Next, the operation unit 40 sets the PWM duty value according to the amount of operation of the switch trigger 6 that is detected (Step 115). Here, the PWM duty value according to the amount of operation can be set to (Maximum PWM duty value)×(amount of operation (%)), for example. Next, the operation unit 40 detects the motor current value I using the output of the current detection circuit 41 (Step 116). Next, the operation unit 40 determines whether or not the setting value (upper limit value) of the PWM duty ratio is set to 100% and the detected motor current value I is equal to or greater than the operation discrimination current threshold $I_1$ (Step 117). Here, when it is determined that the motor current value I is equal to or greater than the operation discrimination current threshold $I_1$, a power-down control flag is set (Step 126), the maximum value of the PWM duty ratio is set to 40% (Step 127) and the control procedure proceeds to Step 122. Here, the power-down control flag is a control flag that is turned on when the motor current value I is less than the operation discrimination current threshold $I_1$. The power-down control flag is used for the execution of a computer program by a microcomputer included in the operation unit 40. When it is determined in Step 117 that the motor current value I is less than the operation discrimination current threshold $I_1$, the power-down control flag is checked and it is determined whether the flag is already set or not (Step 118). When the power-down control flag is detected, 0.1% is added to a value of PWM duty ratio that is set in a previous stage (Step 119) and it is determined whether the present value of the PWM duty ratio is 100% or not (Step 120). Here, when it is determined that the value of the PWM duty ratio is 100%, the power-down control flag is cleared (Step 121) and the control procedure proceeds to Step 122. When it is determined in Step 120 that the value of the PWM duty ratio is not 100%, the control procedure proceeds to Step 122. When the power-down control flag is detected in Step 118, 1% is added to the value of PWM duty ratio that is set in a previous stage (Step 128) and the control procedure proceeds to Step 122.

Next, the operation unit 40 determines whether or not the detected motor current value I is equal to or greater than the stop discrimination current threshold $I_{STOP}$ (Step 122). When it is determined that the motor current value I is equal to or greater than the stop discrimination current threshold $I_{STOP}$ (Step 122), the operation unit 40 stops the motor in Step 123 and the control procedure returns to Step 111. When it is determined that the motor current value I is less than the stop discrimination current threshold $I_{STOP}$ (Step 122), the control procedure returns to Step 122. By repeating the above-described processing, striking is carried out in such a way that rotation by a high duty ratio is performed until just before a first striking is performed and the duty ratio is switched to the low duty ratio within less than one rotation from the start of the striking. Further, in a case where the motor current value I is equal to or less than the operation discrimination current threshold $I_1$ even when the duty ratio is switched to the low duty ratio, the duty ratio is gradually increased at predetermined time intervals (each time interval in which the processing of the present flowchart is performed). Therefore, it is sufficient to perform either one of a process of setting the duty ratio to 40% or a process of adding a predetermined value to a duty ratio, depending on the motor current value I every time when the processing of the flowchart is performed. As a result, it is not necessary to secure a memory area for storing the peak current of the motor current value I. Further, there is no possibility that abrupt increase or decrease of the duty ratio is repeated. Accordingly, it is possible to prevent the striking from being unstable.

Third Embodiment

Figure 10:
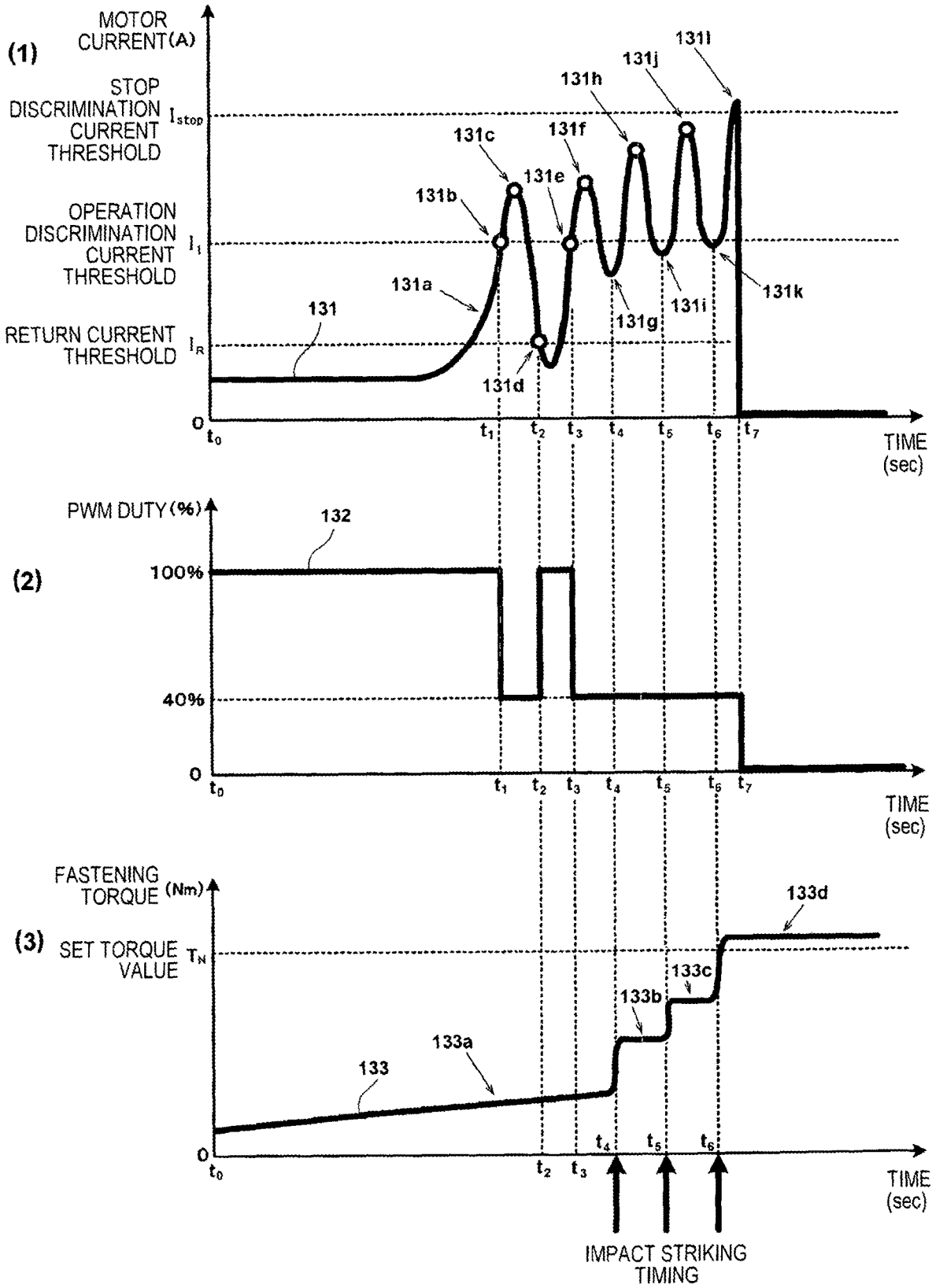
FIG. 10 is a graph showing a relationship among a (1) motor current, a (2) duty ratio of PWM drive signal and a (3) fastening torque in an impact tool according to a third embodiment of the present invention.

Next, a third embodiment of the present invention will be described with reference to FIG. 10 and FIG. 11. In the third embodiment, a control for returning the duty ratio from the low duty ratio to the high duty ratio is added to the first embodiment. FIG. 10 shows relationship among the motor current, the duty ratio of PWM drive signal and the fastening torque in the impact tool of fastening a long screw. First, when rotation of the motor 3 is started at time $t_0$, a motor current 131 is abruptly increased as in an arrow 131*a* in accordance with the fastening situation of the screw and exceeds the current threshold $I_1$ at time $t_1$. Therefore, the operation unit 40 decreases the PWM duty ratio from 100% to 40%. However, thereafter, the motor current 131 reaches a peak as in an arrow 131*c* and then is rapidly decreased as in an arrow 131*d* whereby the motor current is often less than a return current threshold (third threshold) $I_R$. This is a phenomenon that the motor current value I is increased before seating of the screw due to some factors such as the squeezing of iron powder into the threads. In that case, since the motor current 131 and the load torque applied to the motor 3 are increased but the screw is not seated, the torque (fastening torque 133) of fastening the screw to a mating member is little varied as in an arrow 133*a*. Accordingly, according to the third embodiment, in a case where the motor current 131 is less than the return current threshold (third threshold) $I_R$, it is determined that the motor current 131 does not exceed the current threshold $I_1$ due to the seating of the screw or the like. Then, the operation unit 40 returns the duty ratio to 100% at time $t_2$ when the motor current 131 is less than the return current threshold (third threshold) $I_R$. In this way, the driving of the motor 3 is performed.

Next, in a case where the motor current 131 is increased again with progressing of the fastening and exceeds the current threshold $I_1$ again at time $t_3$ as in an arrow 131*e*, again, the operation unit 40 decreases the duty ratio of the PWM from 100% to 40%. Thereafter, the motor current 131 is maximized as in an arrow 131*f* by the retreat of the hammer 24 and then the engagement state between the hammer 24 and the anvil is released, so that the motor current 131 is decreased and a first striking is performed at time $t_4$ in the vicinity where the motor current is lowermost (arrow 131*g*). At this time, the fastening torque value is increased as in an arrow 133*b*. The same striking is performed at times $t_5$, $t_6$ and the motor current at that time is increased or decreased as in arrows 131*h* to 131*k*. Then, since the motor current exceeds the stop discrimination current threshold $I_{STOP}$ at time $t_7$ as in an arrow 1311, the operation unit 40 stops the rotation of the motor 3. Meanwhile, the return current threshold (third threshold) $I_R$ of the duty ratio may be set to be sufficiently smaller than the current threshold $I_1$ so that the motor current 131 after start of striking is not easily lowered less than the return current threshold (third threshold) $I_R$ when being decreased (arrows 131*g*, 131*i*, 131*k*).

Figure 11:
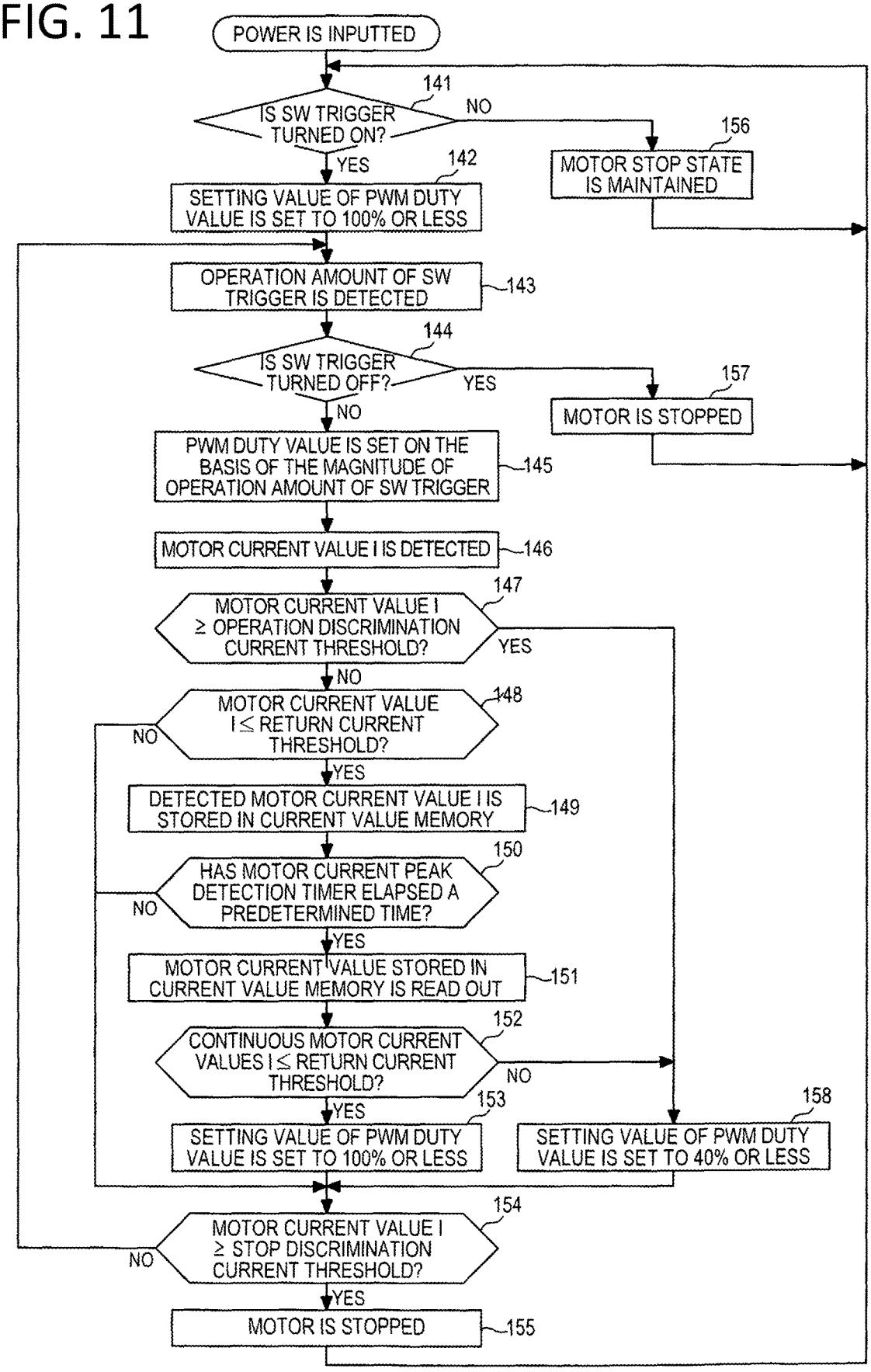
FIG. 11 is a flowchart showing a setting procedure of a duty ratio when performing a fastening work using the impact tool according to the third embodiment of the present invention.
Figure 12:
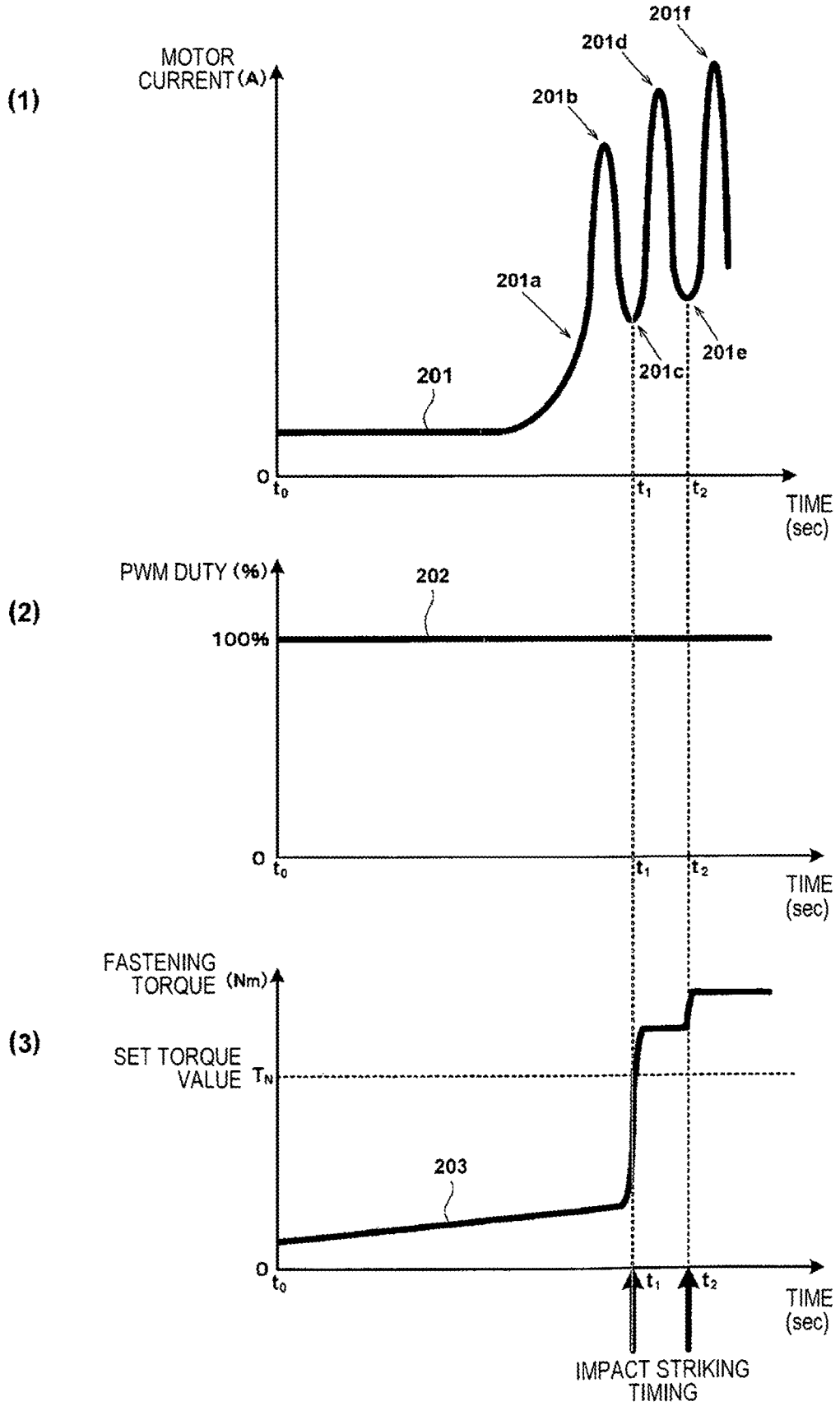
FIG. 12 is a graph showing a relationship among a (1) motor current, a (2) duty ratio of PWM drive signal and a (3) fastening torque in a conventional impact tool.

FIG. 11 shows a flowchart showing a setting procedure of a duty ratio when performing a fastening work using an impact tool 1 according to the third embodiment of the present invention. First, the operation unit 40 detects whether or not the switch trigger 6 is pulled and turned on by an operator (Step 141). When it is detected that the switch trigger is pulled, the control procedure proceeds to Step 142. When it is detected in Step 141 that the switch trigger 6 is pulled, the operation unit 40 sets an upper limit value of the PWM duty value to 100% (Step 142) and detects the amount of operation of the switch trigger 6 (Step 143). Next, the operation unit 40 detects whether or not the switch trigger 6 is released and turned off by an operator (Step 144). When it is detected that the switch trigger is still pulled, the control procedure proceeds to Step 145. When it is detected that the switch trigger is released, the operation unit 40 stops the motor 3 (Step 157) and the control procedure returns to Step 141. Next, the operation unit 40 sets the PWM duty value according to the amount of operation of the switch trigger 6 that is detected (Step 145) and detects the motor current value I using the output of the current detection circuit 41 (Step 146).

Next, the operation unit determines whether or not the detected motor current value I is equal to or greater than the operation discrimination current threshold $I_1$ (Step 147). When it is determined that the motor current value I is equal to or greater than the operation discrimination current threshold $I_1$, the maximum value of the PWM duty ratio is set to 40% (Step 158) and the control procedure proceeds to Step 153. The operation unit determines whether or not the detected motor current value I is equal to or less than the return current threshold $I_R$ (Step 148). When it is determined that the motor current value I is equal to or greater than the return current threshold $I_R$, the control procedure proceeds to Step 154. When it is determined that the motor current value I is equal to or less than the return current threshold $I_R$, the detected motor current value I is stored in a current value memory included in the operation unit (Step 149). As the current value memory, a temporary storage memory such as RAM included in the operation unit can be used. Information for counting the elapsed time of the time detected may be stored together in the current value memory. Next, the operation unit causes a motor current peak detection timer to measure the elapsed time from the time when the motor current value I is equal to or less than the return current threshold $I_R$. Then, the operation unit determines whether or not the measured time exceeds a certain period of time (Step 150). Here, when it is determined that the measured time does not exceed the certain period of time, the control procedure proceeds to Step 154. When it is determined that the measured time exceeds the certain period of time, the operation unit reads out a plurality of motor current values stored in the current value memory (Step 151). Next, the operation unit 40 determines whether or not the read-out motor current value I is continuously equal to or less than the return current threshold $I_R$. When it is determined that the read-out motor current value I is continuously equal to or less than the return current threshold $I_R$, the setting value of the PWM duty value is set to 100% (Step 153). When it is determined that the read-out motor current value I is not continuously equal to or less than the return current threshold $I_R$, the control procedure proceeds to Step 158. Next, the operation unit 40 determines whether or not the detected motor current value I is equal to or greater than the stop discrimination current threshold $I_{STOP}$. When it is determined that the detected motor current value I is equal to or greater than the stop discrimination current threshold $I_{STOP}$, the operation unit stops the motor at Step 155 and the control procedure returns to Step 141. When it is determined that the detected motor current value I is less than the stop discrimination current threshold $I_{STOP}$ (Step 154), the control procedure returns to Step 143.

In this way, in the present embodiment, the duty ratio is not immediately returned to 100 even when the motor current value I is temporarily equal to or less than the return current threshold $I_R$ due to some factors. In other words, the peak current I is observed and the duty ratio is returned to 100% after it is confirmed at Step 152 that the observed current value I is continuously equal to or less than the return current threshold $I_R$. As a result, it is possible to effectively prevent a variation of the duty ratio due to noise or disturbance, etc. The switching of the duty ratio at time $t_2$ as described in FIG. 10 may appear as a control in which it is not observed that the current value I is continuously equal to or less than the return current threshold $I_R$. However, this case just refers to a case where the continuous time is approximated to zero. The continuous time (the certain period of time) can be set in consideration of the features or the like of the impact tool.

By repeating the above-described processing, striking is carried out in such a way that rotation by a high duty ratio is performed until just before a first striking is performed and the duty ratio is switched to the low duty ratio just before less than one rotation from the start of the striking. Accordingly, it is possible to prevent breakage of the screw and also it is possible to securely perform the fastening at a fastening setting torque by plural times of striking. Further, since the motor 3 is driven so as not to generate torque higher than necessary at the time of striking, it is possible to significantly improve the durability of the electric tool even when using a high-power motor 3. Furthermore, since it is possible to reduce the power consumption of the motor 3 when performing the striking, it is possible to extend the life of the battery. Although it is observed that the state is continuous only when the motor current is equal to or less than the return current threshold $I_R$ in the third embodiment, the motor current may be continuously observed also when the detected motor current is equal to or greater than the operation discrimination current threshold $I_1$.

As described above, in the third embodiment, in a case where it is assumed that the motor current 131 is increased by some accidental factors even when the duty ratio is decreased to 40% from 100%, the duty ratio is returned to 100% again and then the fastening work is continuously performed. Accordingly, it is possible to minimize the reduction of the fastening speed.

Hereinabove, although the present invention has been described with reference to the illustrative embodiments, the present invention is not limited to the above-described illustrative embodiments but can be variously modified without departing from the gist of the present invention. For example, although the impact tool to be driven by a battery has been illustratively described in the above-described illustrative embodiment, the present invention is not limited to the cordless impact tool but can be similarly applied to an impact tool using a commercial power supply. Further, although adjustment of the driving power during striking is performed by adjustment of the duty ratio of the PWM control in the above-described illustrative embodiment, the voltage and/or current applied to the motor during striking may be changed by any other methods.

This application is based upon and claims the benefit of priority of Japanese Patent Application No. 2012-280363 filed on Dec. 22, 2012, the contents of which are incorporated herein by reference in its entirety.

The invention claimed is:

1. An impact tool comprising:

a motor as a driving source;

an output shaft;

a rotary striking mechanism driven by the motor;

a switch trigger configured to be operated; and an operation unit configured to control a voltage applied to the motor, wherein the operation unit is configured to:

apply a first voltage to the motor after the switch trigger is manipulated;

lower the voltage after applying the first voltage to the motor and before the rotary striking mechanism transmits a first striking force to the output shaft from the switch trigger is operated; and keep the voltage lower than the first voltage while the rotary striking mechanism transmits a plurality of subsequent striking forces to the output shaft.

2. The impact tool according to claim 1, further comprising:

a current detection circuit configured to detect a current flowing through the motor, wherein the operation unit is configured to lower the voltage when the current exceeds a first current threshold for the first time after applying the first voltage to the motor, the first current threshold being lower than a first peak current flowing through the motor just before the first striking force is transmitted to the output shaft.

3. The impact tool according to claim 2, wherein the operation unit is configured to increase the voltage when the current decreases below a return current threshold, which is smaller than the first current threshold, after the current exceeds the first current threshold.

4. The impact tool according to claim 1, wherein the rotary striking mechanism comprises a hammer, and wherein the hammer is configured to:

engage with the output shaft when a torque applied between the hammer and the output shaft is smaller than a retreating torque;

begin to retreat from the output shaft when the torque is equal to or larger than the retreating torque and smaller than a disengaging torque; and disengage from the output shaft when the torque is equal to or larger than the disengaging torque.

5. The impact tool according to claim 4, wherein the operation unit is configured to lower the voltage after applying the first voltage to the motor and before the hammer disengages from the output shaft for the first time.

6. The impact tool according to claim 4, wherein the operation unit is configured to lower the voltage after applying the first voltage to the motor and before the hammer begins to retreat from the output shaft for the first time.

7. The impact tool according to claim 4, further comprising:

a current detection circuit configured to detect a current flowing through the motor, wherein the motor and the rotary striking mechanism are connected such that the current increases in accordance with an increase of the torque applied between the hammer and the output shaft.

8. The impact tool according to claim 7, wherein the operation unit is configured to lower the voltage after applying the first voltage to the motor and before the current increases to a disengaging current corresponding to the disengaging torque for the first time.

9. The impact tool according to claim 8, wherein the operation unit is configured to increase the voltage when the current decreases below a return current threshold, which is smaller than the disengaging current, after the current exceeds the disengaging current.

10. The impact tool according to claim 7, wherein the operation unit is configured to lower the voltage after applying the first voltage to the motor and before the current increases to a retreating current corresponding to the retreating torque for the first time.

11. The impact tool according to claim 10, wherein the operation unit is configured to increase the voltage when the current decreases below a return current threshold, which is smaller than the retreating current, after the current exceeds the retreating current.

12. The impact tool according to claim 1, wherein the operation unit is configured to control the voltage in accordance with a duty ratio of a pulse width modulation control.

13. A method of tightening a screw using an impact tool comprising a motor as a driving source, an output shaft holding a tip tool to tighten the screw, a rotary striking mechanism driven by the motor, and a switch trigger configured to be operated, the method comprising the steps of:

manipulating the switch trigger to start tightening the screw;

applying a voltage to the motor after manipulating the switch trigger, a value of the voltage being a first voltage;

lowering the voltage after applying the first voltage to the motor and before the rotary striking mechanism transmits a first striking force to the output shaft;

keeping the voltage to be lower than the first voltage while the rotary striking mechanism transmits a plurality of subsequent striking forces to the output shaft; and releasing the switch trigger to stop tightening the screw.

14. The method according to claim 13, wherein the rotary striking mechanism comprises a hammer configured to engage with the output shaft or to disengages from the output shaft in accordance with a torque applied between the hammer and the output shaft.

15. The method according to claim 14, further comprising the step of:

lowering the voltage after applying the first voltage to the motor and before the hammer disengages from the output shaft for the first time.

16. The method according to claim 14, further comprising the step of:

lowering the voltage after applying the first voltage to the motor and before the hammer begins to retreat from the output shaft for the first time.

* * * * *